US008309188B2

(12) United States Patent
Cheng et al.

(10) Patent No.: US 8,309,188 B2
(45) Date of Patent: Nov. 13, 2012

(54) PULL UP TREE SYSTEM

(75) Inventors: Lewis Cheng, Hong Kong (CN); Thomas MacMartin Harman, II, Palo Alto, CA (US)

(73) Assignee: Polygroup Macau Limited (BVI), Road Town, Tortola (VG)

( * ) Notice: Subject to any disclaimer, the term of this patent is extended or adjusted under 35 U.S.C. 154(b) by 57 days.

(21) Appl. No.: 12/955,960

(22) Filed: Nov. 30, 2010

(65) Prior Publication Data

US 2011/0076425 A1 Mar. 31, 2011

Related U.S. Application Data

(63) Continuation-in-part of application No. 12/496,478, filed on Jul. 1, 2009.

(60) Provisional application No. 61/078,580, filed on Jul. 7, 2008.

(51) Int. Cl.
*A47G 33/06* (2006.01)

(52) U.S. Cl. ..... 428/20; 428/18; 229/117.3; 229/17.27

(58) Field of Classification Search ..... 428/20
See application file for complete search history.

(56) References Cited

U.S. PATENT DOCUMENTS

| | | | | | |
|---|---|---|---|---|---|
| 1,654,427 | A | * | 12/1927 | Modlarz | 211/196 |
| 3,079,061 | A | * | 2/1963 | Wojcik | 206/521 |
| 3,674,612 | A | | 7/1972 | Gehl, Jr. | |
| 3,677,867 | A | * | 7/1972 | Westlund | 428/9 |
| 3,692,617 | A | * | 9/1972 | Marks et al. | 428/20 |
| 3,846,213 | A | | 11/1974 | Thiemann | |
| 4,054,696 | A | | 10/1977 | Crownover | |
| 4,130,678 | A | * | 12/1978 | Higgins | 428/9 |
| 4,140,823 | A | | 2/1979 | Weskamp | |
| 4,331,720 | A | * | 5/1982 | Vin Dick et al. | 428/9 |
| 4,496,615 | A | | 1/1985 | Huang | |
| 4,659,597 | A | | 4/1987 | Lau | |
| 4,746,022 | A | * | 5/1988 | Benham | 211/195 |
| 4,748,058 | A | | 5/1988 | Craig, Jr. | |
| 4,847,123 | A | | 7/1989 | Armstead et al. | |

(Continued)

FOREIGN PATENT DOCUMENTS

GB 2041747 A * 9/1980

OTHER PUBLICATIONS

Examination Report issued by the Intellectual Property Office dated Jun. 17, 2011.

(Continued)

*Primary Examiner* — Aaron Austin
(74) *Attorney, Agent, or Firm* — Ryan A. Schneider, Esq.; Troutman Sanders LLP

(57) ABSTRACT

A pull up artificial tree system is adapted to change from a collapsed storage state to an expanded operable state. The pull up tree system includes a base system, a trunk, and a first tree assembly. The first tree assembly includes a top portion; a plurality of frame assemblies comprising a collar, a plurality of outwardly extending support braces, a perimeter, and branch assemblies; and a connection assembly. The collars are slidably disposed upon the trunk, such that they can be pulled upwardly. The pull up tree system can support a regularly arranged artificial tree and/or an inverted tree. In addition, the pull up tree system can be stored in a shell that is slidably disposable within a storage container.

18 Claims, 21 Drawing Sheets

U.S. PATENT DOCUMENTS

| | | | | | |
|---|---|---|---|---|---|
| 4,968,541 | A | * | 11/1990 | McCrory | 428/9 |
| 5,085,901 | A | | 2/1992 | Johnson et al. | |
| 5,106,661 | A | | 4/1992 | Pitts, Sr. | |
| 5,336,536 | A | * | 8/1994 | Oberzan | 428/8 |
| 5,405,662 | A | * | 4/1995 | Oberzan | 428/8 |
| 5,413,825 | A | | 5/1995 | Chaikin | |
| 5,652,032 | A | * | 7/1997 | Kaczor et al. | 428/18 |
| 5,906,869 | A | | 5/1999 | Thomas | |
| 5,975,317 | A | * | 11/1999 | Roebling | 211/45 |
| RE36,640 | E | | 4/2000 | Frost et al. | |
| 6,048,590 | A | * | 4/2000 | Phillips | 428/9 |
| 6,062,701 | A | * | 5/2000 | Hines | 362/123 |
| 6,139,168 | A | * | 10/2000 | Gary et al. | 362/249.19 |
| 6,200,656 | B1 | * | 3/2001 | Tsang | 428/20 |
| 6,333,083 | B1 | | 12/2001 | Smedley et al. | |
| 6,334,694 | B1 | | 1/2002 | Huang | |
| 6,379,021 | B1 | * | 4/2002 | Shieh | 362/123 |
| 6,514,581 | B1 | | 2/2003 | Gregory | |
| 6,663,921 | B1 | | 12/2003 | Quigel | |
| 7,089,878 | B2 | * | 8/2006 | Huang | 116/63 C |
| 7,152,998 | B2 | * | 12/2006 | Rahman | 362/249.19 |
| 7,267,852 | B1 | | 9/2007 | Rosado et al. | |
| 7,320,816 | B2 | * | 1/2008 | Quigel | 428/18 |
| 7,445,823 | B2 | | 11/2008 | Tennison | |
| 2005/0048226 | A1 | | 3/2005 | Gary et al. | |
| 2008/0185307 | A1 | | 8/2008 | Hecht et al. | |
| 2008/0257770 | A1 | | 10/2008 | Limber | |
| 2010/0000065 | A1 | | 1/2010 | Cheng et al. | |

OTHER PUBLICATIONS

Examination Report under Section 18(3) dated Nov. 3, 2010 issued by the British Patent Office for related British Application No. GB0911780.5.

Search Report dated Nov. 5, 2009, issued by the British Patent Office for related British Application No. GB0911780.5.

* cited by examiner

PULL UP TREE SYSTEM

CROSS REFERENCE TO RELATED APPLICATION

This application is a continuation-in-part of and claims benefit of U.S. patent application Ser. No. 12/496,478 filed 1 Jul. 2009, which claims benefit under 35 U.S.C. §119(e) of U.S. Provisional Patent Application Ser. No. 61/078,580 filed 7 Jul. 2008, the entire contents and substance of which are hereby incorporated by reference as if fully set forth herein below.

BACKGROUND OF THE INVENTION

1. Field of the Invention

Embodiments of the present invention relate to an artificial tree system adapted to change between a collapsed state for storage and an assembled state for operation.

2. Description of the Related Art

As part of the celebration of the Christmas season, traditionally people bring a pine or evergreen tree into their home to decorate it with ornaments, lights, garland, tinsel, and the like. More traditionally, people obtain a cut, natural pine tree and bring it into the home for decorating and displaying over the Christmas season. Natural trees, however, can be quite expensive and are recognized by some as a waste of environmental resources. In addition, such trees can be messy, leaving both sap and needles behind after removal, and requiring water to prevent drying out and becoming a fire hazard. Each time a natural tree is obtained it must be decorated, and at the termination of the Christmas season the decorations must be removed. Because the needles have dried and may be quite sharp by this time, removal of the decorations can prove to be a painful process. Also, oftentimes the natural tree is disposed in landfills, further polluting these overflowing settings. Further, a natural tree, especially with dried needles and limbs, becomes a potential fire hazard.

To overcome the disadvantages of a natural tree and still celebrate with a Christmas tree, a great variety of artificial trees are available. For the most part, these artificial trees must be assembled for use and disassembled after use. Artificial trees have the advantage of being usable over a period of years and thereby eliminate the annual expense of purchasing live trees for the short holiday season. Further, they help reduce the chopping down of trees for a temporary decoration, and the subsequent disposal, typically in a landfill, of same.

Artificial trees can be made of synthetic materials that are more fire resistant than the natural trees. Advantageously, they require no watering and they need less protection than natural trees from bumps and scraps that strip needles from limbs. In addition, because they can be machine-made, they may also be fashioned to a near perfect symmetry.

Even the advantages of natural trees are not lost with use of artificial trees. The versatility of modern materials in the texture, color, and shape of evergreen needles bring visual warmth to the artificial product. Room deodorants and other such means can duplicate the aroma of a natural tree. Moreover, many attempts have been made to make artificial Christmas trees that are substantially ready when taken from storage.

Generally, most artificial Christmas trees comprise a multiplicity of separate branches each formed of a plurality of plastic needles held together by twisting a pair of wires about them. In other instances, the branches are formed by twisting a pair of wires about an elongated sheet of plastic material having a large multiplicity of transverse slits. In still other artificial Christmas trees, the branches are formed by injection molding of plastic.

Irrespective of the form of branch, the most common form of artificial Christmas tree comprises a wood-simulated trunk having a plurality of spaced apart apertures for receiving the branches therein to thereby hold the branches in radially extending relation to the trunk to form the artificial Christmas tree. For purposes of storage, the branches are removable, requiring the repositioning of the branches on the trunk each time the tree is reassembled. The difficulty of this task is, however, somewhat reduced by color coding the apertures on the trunk with the ends of the branches.

To provide a tree that can be stored without occupying an unduly large amount of space and yet to avoid the need for totally dismantling the tree at the end of each Christmas season and reassembling at the beginning of the next, it has been contemplated to permanently pivotably affix the artificial branches of an artificial Christmas tree to the trunk to permit movement of the branches between an outwardly deployed position and a storage position in which the branches lie close to the trunk and thereby occupy a comparatively small space.

BRIEF SUMMARY OF THE INVENTION

Briefly described, various embodiments of the present invention relate to a pull up tree system. Exemplary embodiments of the pull up tree system relate to an artificial tree and comprise a base system, a trunk, and a first tree assembly. The pull up tree system includes a first, collapsed state, and a second, operational or assembled state.

The base system provides the structural integrity to position the artificial tree in a particular orientation, preferably in a substantially vertical orientation. The base system comprises a base, such as stand, which includes a plurality of feet for stabilizing purposes.

The trunk is of rigid construction and includes a first end and a second end. The first end of the trunk is in communication with the base of the base system. For example, the trunk can be positioned in a substantially vertical orientation by being coupled to the base. The trunk can be insertable into and cooperatively received by a cavity of the base.

The first tree assembly comprises the entirety or, alternatively, a bottom portion of the artificial tree. The first tree assembly can be collapsible for storage and can be expandable for operation and use. In an exemplary embodiment, the first tree assembly includes a top portion; a plurality of frame assemblies, wherein each frame assembly comprises a collar, a plurality of outwardly extending support braces, a perimeter, and a plurality of branch assemblies; and a connection assembly.

A plurality of frame assemblies can be positioned about, or encircle, the trunk. More specifically, the collar of each of the plurality of frame assemblies can be positioned about, or encircle, the trunk. When the trunk is in communication with the base, the first tree assembly can begin in a collapsed state and hence the trunk extends upwardly from the base. Each collar of the plurality of frame assemblies surrounds the trunk. Accordingly, the collars of the plurality of frame assemblies can be slidably disposed upon the trunk.

The plurality outwardly extending support braces extend from the collar to the perimeter. The collar is concentric relative to the perimeter, and the two are interconnected via the plurality of support braces. The branch assemblies can be coupled about the perimeter of each of the plurality of the frame assemblies.

The connection assembly of the first tree assembly extends from the top portion of the first tree assembly and connects each of its frame assemblies. For example, the connection assembly can be coupled to each frame assembly. The connection assembly can be flexible, and, in an exemplary embodiment, includes a plurality of strings coupled near a first end to the top portion, e.g., wrapped within an aperture of the top portion, and is connected (e.g., tied) along its length to each perimeter of the plurality of frame assemblies and ultimately terminates near the perimeter of the lowest most frame assembly.

When the first tree assembly is in the collapsed state and the trunk is coupled to the base, and hence the trunk extends upwardly therefrom, a handle in communication with a top portion of the first tree assembly can be pulled upwardly, such that the collars of the plurality of frame assemblies slide along the trunk. When the handle is pulled upwardly the connection assembly pulls each of the frame assemblies upwardly. As a result, each of the branch assemblies is now separated from one another and provides the illusion of a partially/fully assembled tree. When the handle reaches the second end, or the top, of the trunk, the first tree assembly is assembled.

In addition, with the locking mechanism, the first tree assembly can be secured in the operable, or assembled, orientation. The locking mechanism helps secure the top portion of the first tree assembly to the second end of the trunk.

In some embodiments, the top portion of the first tree system can be lifted up and over the top of the trunk. In some embodiments, the top portion can slide along the trunk.

In an exemplary embodiment, a method of assembling the artificial tree is provided. The artificial tree can be carried by a device, e.g., a tray or shell, to be slid out of a container, e.g., a box. When removed from the container, the trunk can be inserted through all the collars and connected to the base system. The top portion can be pulled up and over the trunk. For example, a user can pull up on a handle, lifting the top ring of the top portion up and over the top end of the trunk, and resting it on a square support in proximity to the top end of the trunk. Alternatively, the top portion can slide along the trunk and be locked in proximity or to the top of the trunk. In some embodiments, a second tree assembly can be placed on top of the trunk, and then the lights can be connected.

In an exemplary embodiment, the first tree assembly provides the entire shape of the artificial tree. Yet, in another embodiment, a second tree assembly is needed, because the first tree assembly did not make up the entirety of the artificial tree.

The second tree assembly can comprise a top tree assembly of the artificial tree. In an exemplary embodiment, the second tree assembly is couplable to the second end of the trunk. For example, an end of the second tree assembly is insertable and can be received by an aperture in the second end of the trunk or vice versa.

In various aspects of the artificial tree, it can be decorated, such that ornaments, light string system(s), and the like hang therefrom. In addition, the light string systems can be integral with the plurality of the branch assemblies, such that the artificial tree comes, e.g., is sold, with a light string system weaved therethrough.

These and other objects, features, and advantages of the present invention will become more apparent upon reading the following specification in conjunction with the accompanying drawing figures.

BRIEF DESCRIPTION OF THE DRAWINGS

The various embodiments of the invention can be better understood with reference to the following drawings. The components in the drawings are not necessarily to scale, emphasis instead being placed upon clearly illustrating the principles of the various embodiments of the present invention. In the drawings, like reference numerals designate corresponding parts throughout the several views.

DETAILED DESCRIPTION OF PREFERRED EMBODIMENTS

Figure 1:
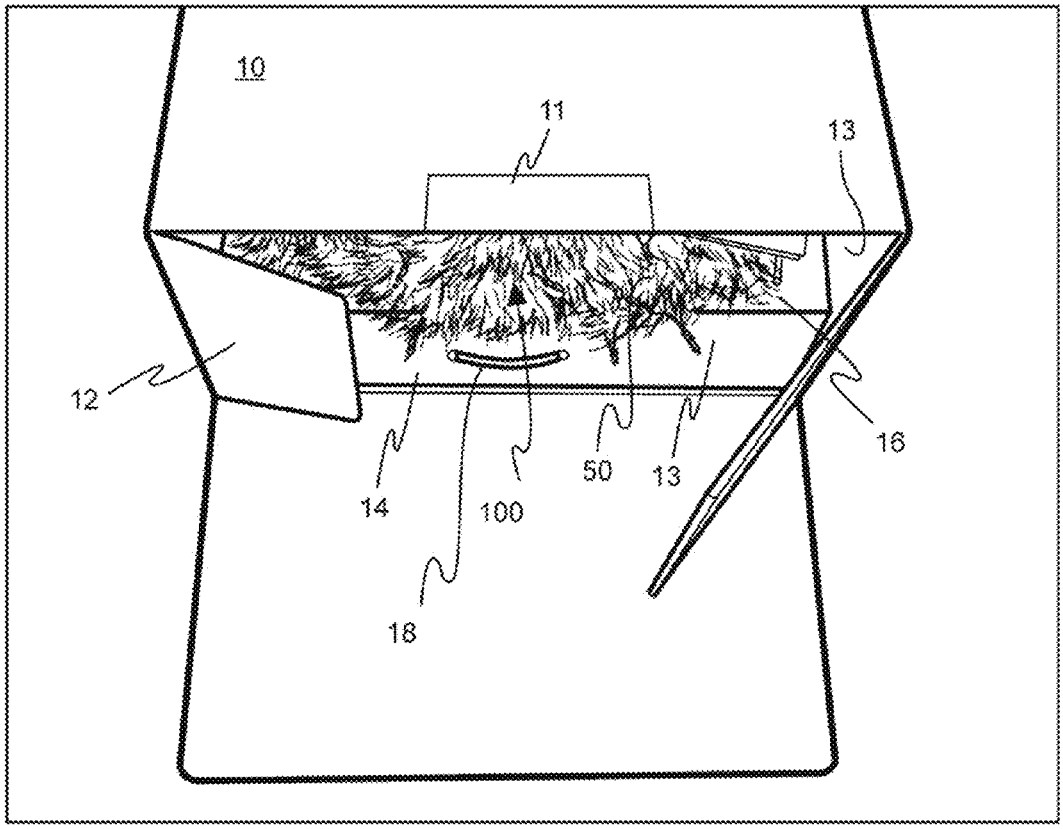
FIG. 1 is a top perspective view of a pull up tree system predominately housed within a storage container, in accordance with an exemplary embodiment of the present invention.

Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

The components described hereinafter as making up various elements of the invention are intended to be illustrative and not restrictive. Many suitable components that would perform the same or similar functions as the components described herein are intended to be embraced within the scope of the invention. Such other components not described herein can include, but are not limited to, for example, similar components that are developed after development of the invention.

It must also be noted that, as used in the specification and the appended claims, the singular forms "a," "an" and "the" include plural referents unless the context clearly dictates otherwise.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" one particular value and/or to "about" or "approximately" another particular value. When such a range is expressed, another embodiment includes from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Various embodiments of the present invention comprise an artificial pull up tree system. Exemplary embodiments of artificial tree pull up systems can comprise a storage system, a base system, a first tree assembly, and a second tree assembly.

The pull up tree system includes a first, collapsed state, and a second, operational or assembled state. The pull up tree system includes at least a base system, a trunk, and a first tree assembly.

The base system provides the structural integrity to position the artificial tree in a particular orientation, preferably in an approximate vertical orientation. The base system comprises a base, such as a stand, which includes a plurality of feet for stabilizing purposes.

The trunk is of rigid construction and includes a first end and a second end. The first end of the trunk is in communication with the base of the base system. For example, the trunk can be positioned substantially vertical by being coupled to the base. The trunk can be insertable into and cooperatively received by a cavity of the base.

The first tree assembly comprises the entirety or, alternatively, a bottom portion of the artificial tree. The first tree assembly can be collapsible for storage and can be expandable for operation and use. In an exemplary embodiment, the first tree assembly includes a top portion; a plurality of frame assemblies, wherein each frame assembly comprises a collar, a plurality of outwardly extending support braces, a perimeter, and branch assemblies; and a connection assembly.

A plurality of frame assemblies can be positioned about, or encircle, the trunk. More specifically, the collar of each of the plurality of frame assemblies can be positioned about, or encircle, the trunk. When the trunk is in communication with the base, the first tree assembly can begin in a collapsed state and hence the trunk extends upwardly from the base. Each collar of the plurality of frame assemblies surrounds the trunk. Accordingly, the collars of the plurality of frame assemblies can be slidably disposed upon the trunk.

The plurality outwardly extending support braces extend from the collar to the perimeter. The collar is concentric relative to the perimeter, and the two are interconnected via the plurality of support braces. The branch assemblies can be coupled about the perimeter of each of the plurality of the frame assemblies.

The connection assembly of the first tree assembly extends from the top portion of the first tree assembly and connects to each of the frame assemblies. The connection assembly can be flexible, and, in an exemplary embodiment, includes a plurality of strings coupled near a first end to the top portion, e.g., wrapped within an aperture of the top portion, and is connected along its length to each perimeter of the plurality of frame assemblies and ultimately terminates near the perimeter of the lowest most frame assembly.

When the first tree assembly is in the collapsed state and the trunk is coupled to the base, and hence the trunk extends upwardly therefrom, a handle in communication with a top portion of the first tree assembly can be pulled upwardly, such that the collars of the plurality of frame assemblies slide along the trunk. When the handle is pulled upwardly the connection assembly pulls each of the frame assemblies upwardly. As a result, each of the branch assemblies is now separated from one another and provides the illusion of a partially/fully assembled tree. When the handle reaches the second end, or the top, of the trunk, the first tree assembly is assembled.

In addition, with the locking mechanism, the first tree assembly can be secured in the operable, or assembled, orientation. The locking mechanism helps secure the top portion of the first tree assembly in proximity or to the second end of the trunk. In an alternative embodiment, the top portion can be lifted up and over a top of the trunk, and can rest on a resting section of in proximity to the top of the trunk, e.g., the circular top portion can rest on a square peg in proximity to the top of the trunk.

In an exemplary embodiment, the first tree assembly provides the entire shape of the artificial tree. Yet, in another embodiment, a second tree assembly is needed, because the first tree assembly need not make up the entirety of the artificial tree.

The second tree assembly can comprise a top tree assembly of the artificial tree. In an exemplary embodiment, the second tree assembly is couplable to the second end of the trunk. For example, an end of the second tree assembly is insertable and can be received by an aperture in the second end of the trunk or vice versa.

In various aspects of the artificial tree, it can be decorated, such that ornaments, light string system(s), and the like hang therefrom. In addition, the light string systems can be integral with the plurality of the branch assemblies, such that the artificial tree comes, e.g., is sold, with a light string system weaved therethrough.

Referring now to the figures, wherein like reference numerals represent like parts throughout the views, the artificial tree will be described in detail.

FIG. 1 illustrates a top, perspective view of a pull up tree system 100 positioned in a storage container 10. The storage container 10 is a cubic storage system having preferably six sides. At least one side 12 is openable. In an exemplary embodiment, the storage container 10 may be a cardboard or corrugated plastic box that defines a center cavity 16 for holding and carrying the artificial tree 50.

The openable side 12 is large enough to permit the removal/insertion of the pull up tree system 100, such that the pull up tree system can be slid out of the storage container 10. In an exemplary embodiment, the openable side 12 is identified, such that the exterior of the storage container 10 provides indicia or drawings to indicate which side to open; this is shown by indicia 11, which can state, e.g., "Open Here." In an exemplary embodiment, the pull up tree system 100 can be carried by a device 13, e.g., a slidable shell 14 or a slidable tray.

In an exemplary embodiment, the shell 14 comprises a lower closed end, an upper open end, and a peripheral wall. The peripheral wall extends upwardly from the lower closed end to the upper open end, thereby defining a cavity above the lower closed end of the shell 14. The cavity 16 can receive and secure the artificial tree 50. Moreover, the artificial tree 50 can rest on the lower closed end of the storage container 10.

On the exterior of at least one peripheral wall of the shell 14, a handle 18 can extend outwardly for enabling a user to slide the shell 14 to/from the interior of the storage container 10. The handle 18 can have an ergonomic shape for comfortable handling by the user.

Figure 2:
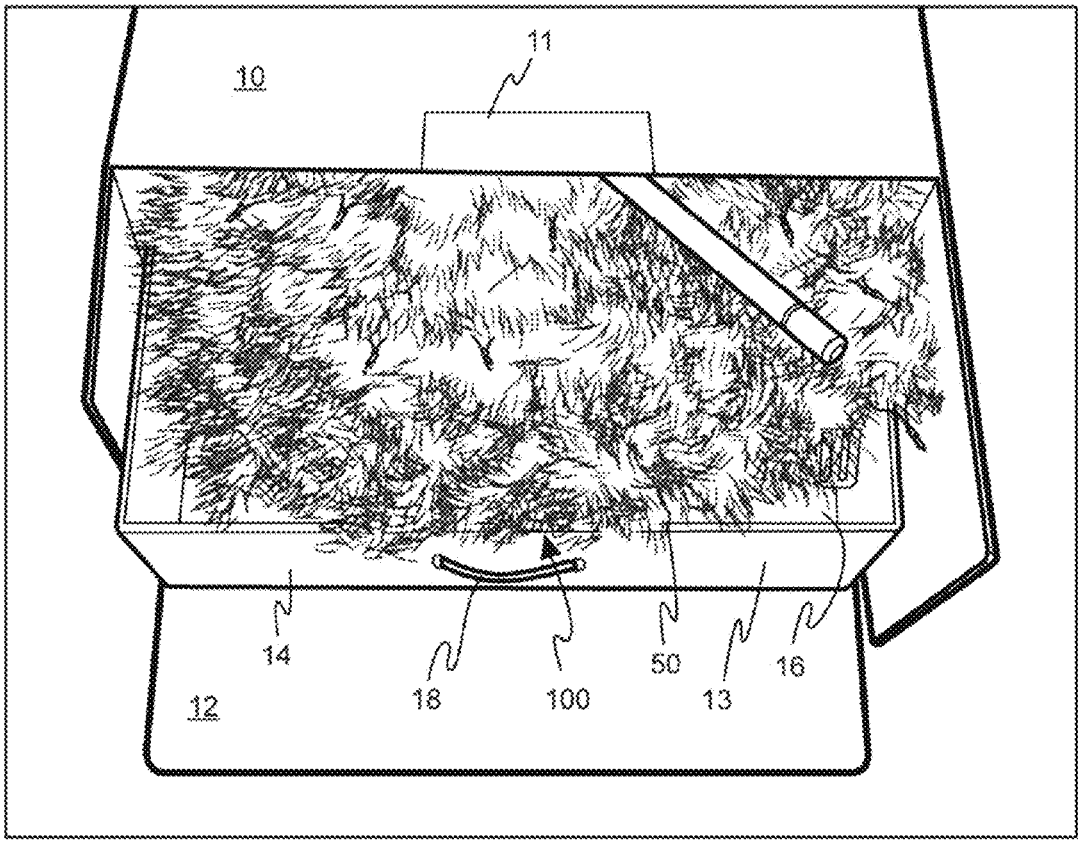
FIG. 2 is a top perspective view of the pull up tree system partially housed within a storage container, in accordance with an exemplary embodiment of the present invention.

FIG. 2 illustrates the shell 14 partially slid out of the storage container 10, in accordance with an exemplary embodiment of the present invention. This position of the shell 14 can occur after opening the storage container 10 and then pulling on the handle 18 of the shell 14; alternatively, this can occur when inserting the shell 14 into the storage container 10. The storage container 10 can house the artificial tree 50.

Figure 3:
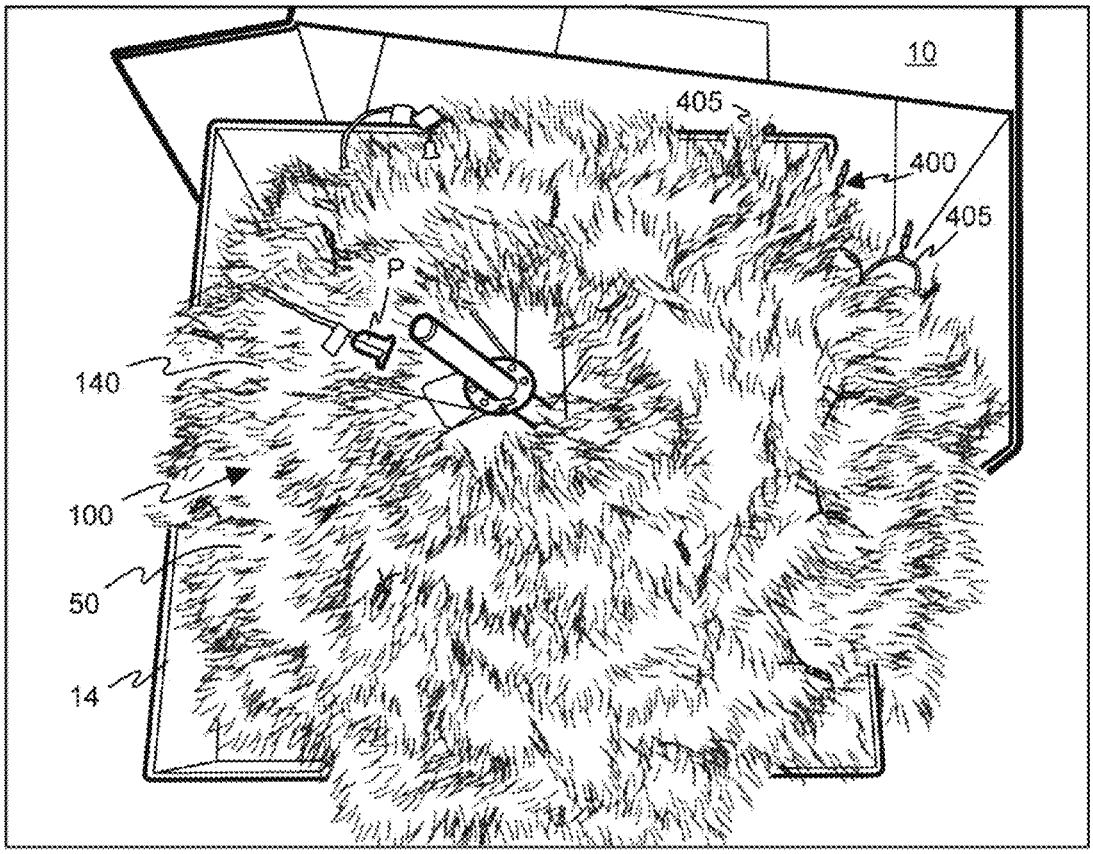
FIG. 3 is a top perspective view of the pull up tree system in a collapsed state, in accordance with an exemplary embodiment of the present invention.
Figure 4A:
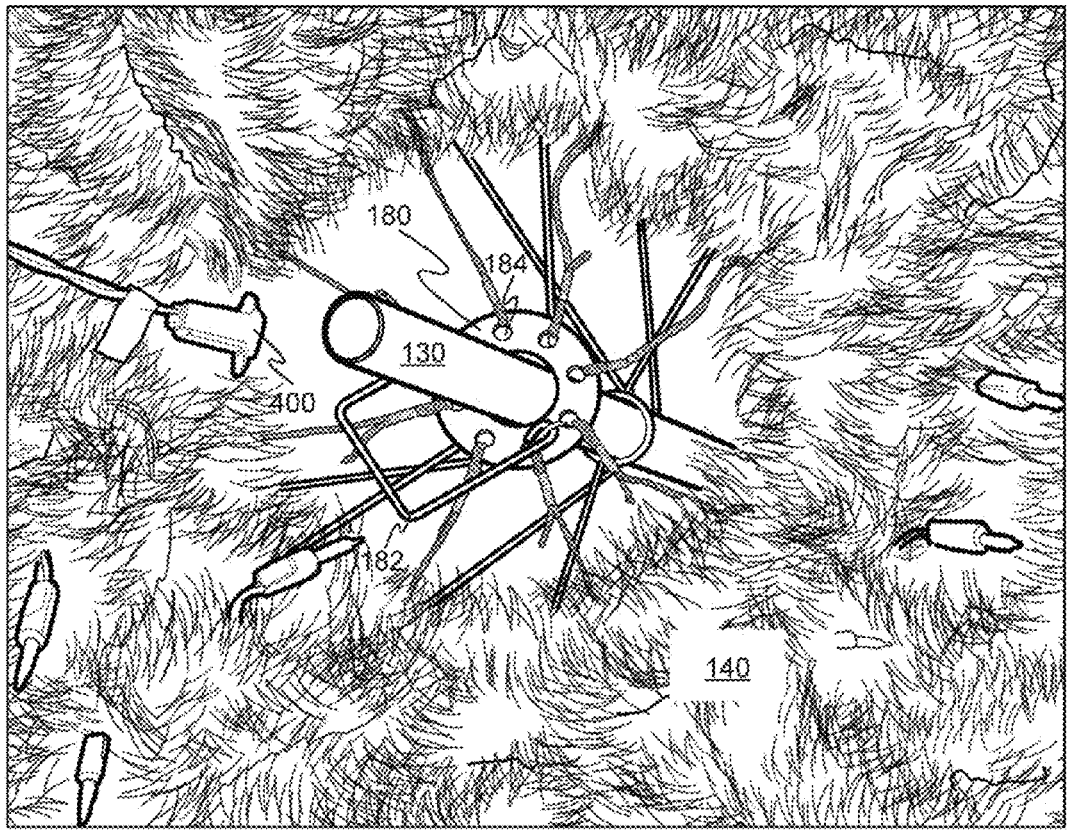
FIGS. 4A-4B are close-up, top, perspective views of the pull up tree system in a collapsed state, in accordance with an exemplary embodiments of the present invention.
Figure 4B:
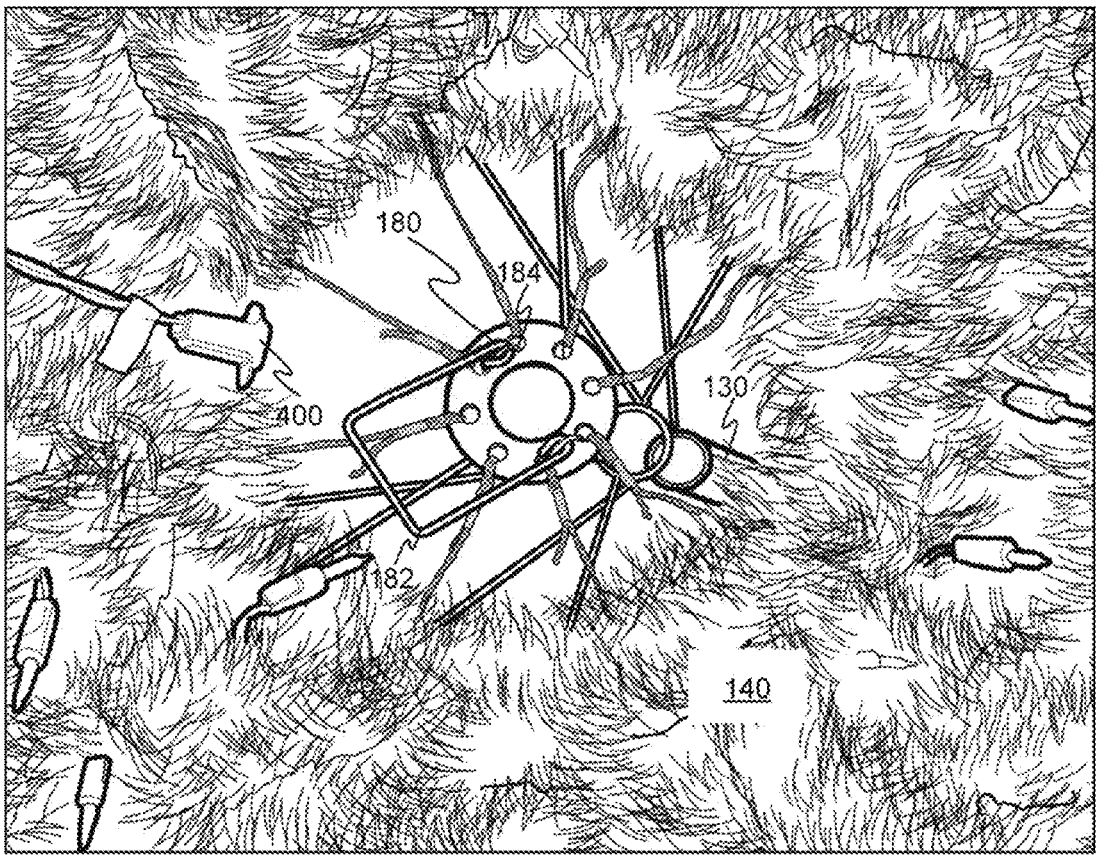
Figure 5:
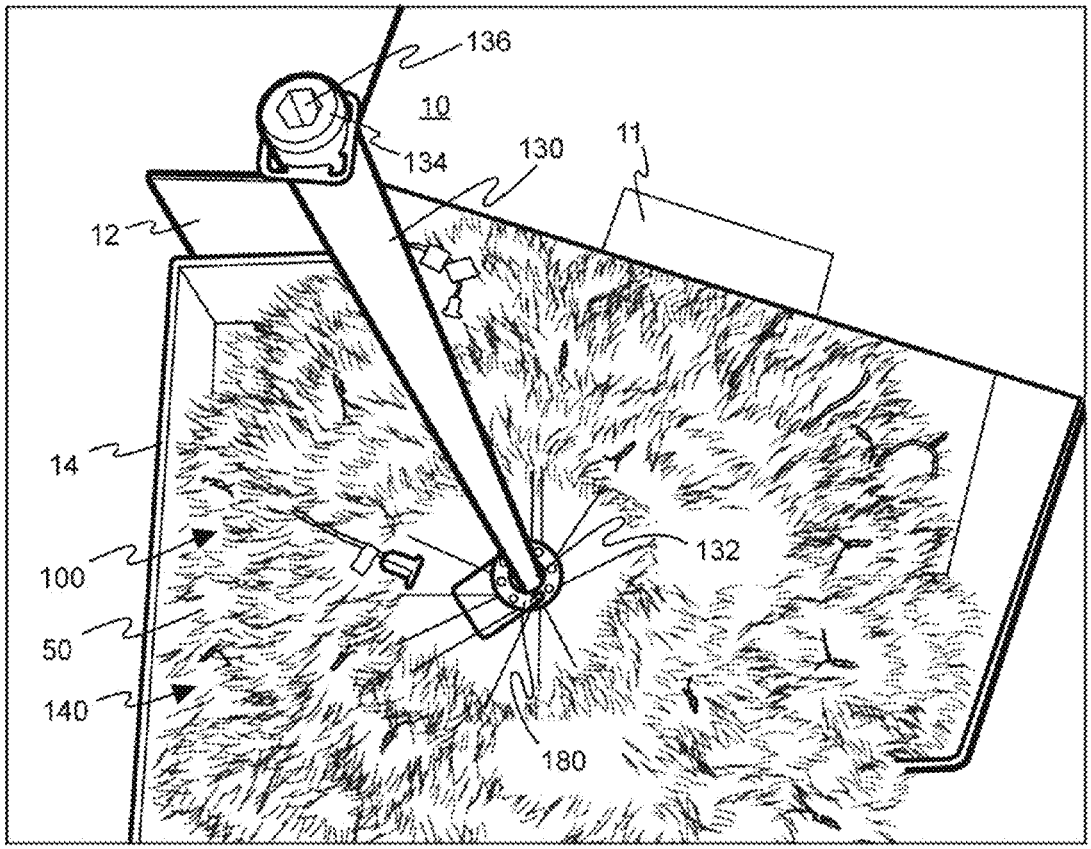
FIG. 5 is top, perspective view of a first tree assembly of the pull up tree system, in accordance with an exemplary embodiment of the present invention.

Referring now to FIGS. 3-4B, the shell 14 is shown fully outside from the storage container 10.

In an exemplary embodiment, the storage container 10 can provide an improved means to store the artificial tree. When the tree 50 is a collapsed state, it can be positioned in the shell 14, and then the shell 14 can slide into the cavity 16 of the storage container 10. Once the sides of the storage container 10 are sealed, the storage container 10 can be stored in a desired location. This can reduce and ease the task of reducing the size of and storing the tree 50. The storage container 10 provides an improved means to remove the storage of the artificial tree, by providing the shell 14 to slide via the handle 18 from the storage container 10. A bottom of the lower closed end of the shell 14 may include a transportation portion, e.g., wheel mechanisms, easing the task of removing and/or inserting the shell 14 in the storage container 10. Generally, FIGS. 1-3 illustrate both the removal and insertion of the shell 14 from/into the storage container 10.

As noted, the pull up tree system 100 includes an artificial tree 50 that includes a first, collapsed state and a second, operable state. The artificial tree 50 can collapse along its branches (inwardly) and/or along its trunk (downwardly). In an exemplary embodiment, the artificial tree 50 includes a base system 120 (see FIG. 11) and a first tree assembly 140 (see FIGS. 3-7).

Figure 11:
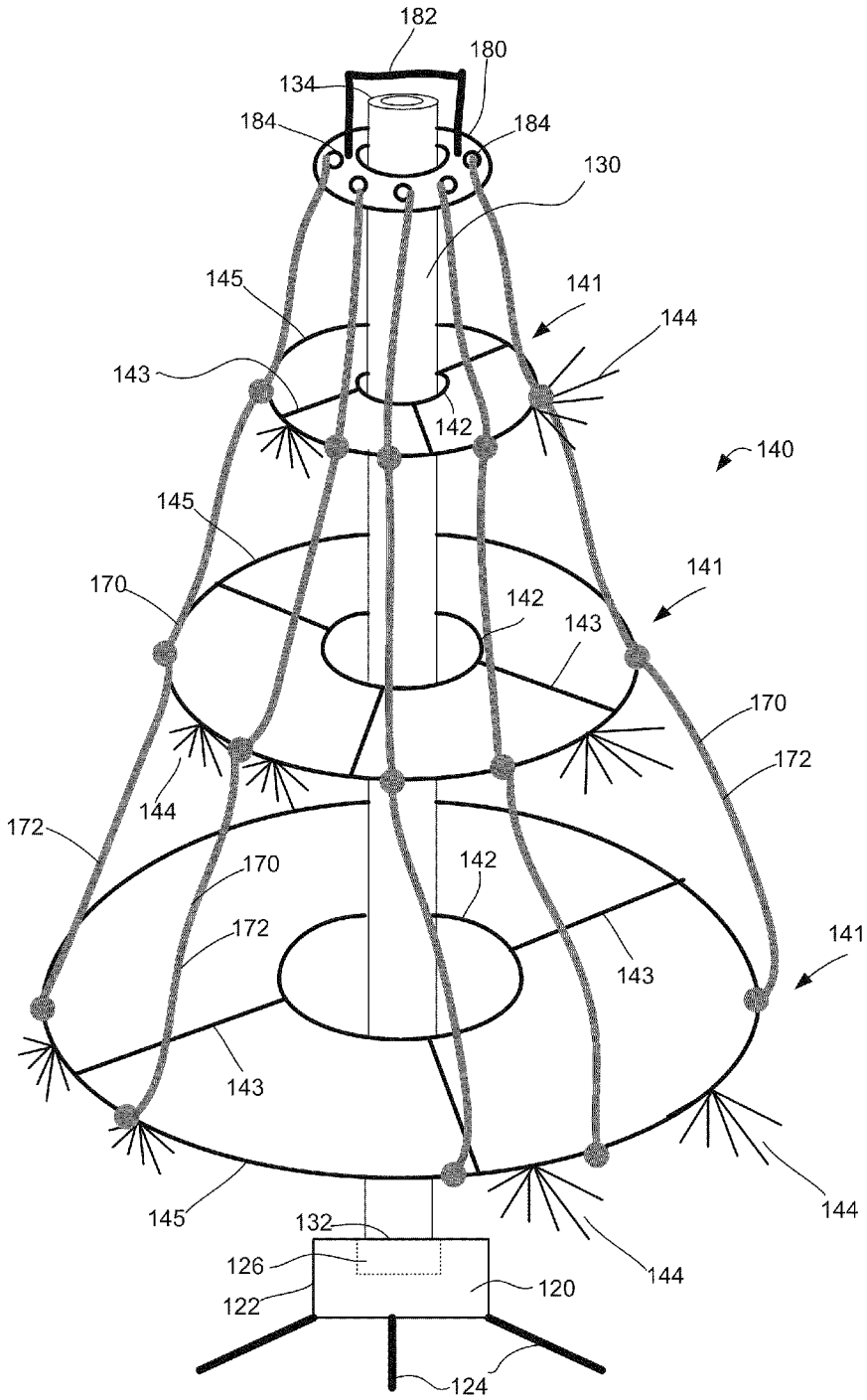
FIG. 11 is a side, perspective view of a top portion, a connection assembly, and a plurality of frame assemblies of a first tree assembly, in accordance with an exemplary embodiment of the present invention.

The base system 120 provides the structural integrity to position the artificial tree 50 in a particular orientation, preferably in a vertical orientation. As shown in FIG. 11, the base system 120 comprises a base 122, such as tree stand, which includes a plurality of feet 124 for stabilizing purposes. An exemplary stand is provided in a pending patent application, having U.S. Ser. No. 12/186,133, filed 5 Aug. 2008, which is incorporated by reference as if fully set forth below. Other tree stands and/or bases can be implemented in various aspects of the present invention.

Figure 6A:
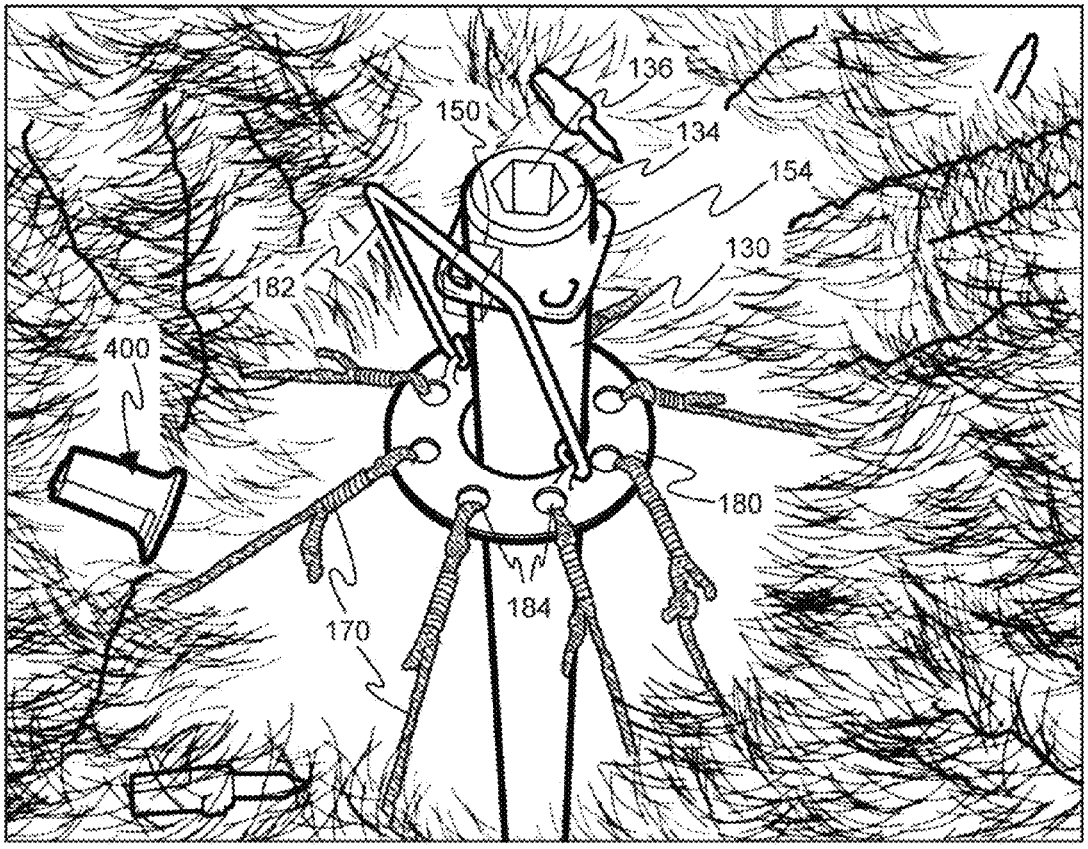
FIG. 6A is a close-up, side, perspective view of the first tree assembly locked in proximity to a top end of the trunk, in accordance with an exemplary embodiment of the present invention.
Figure 6B:
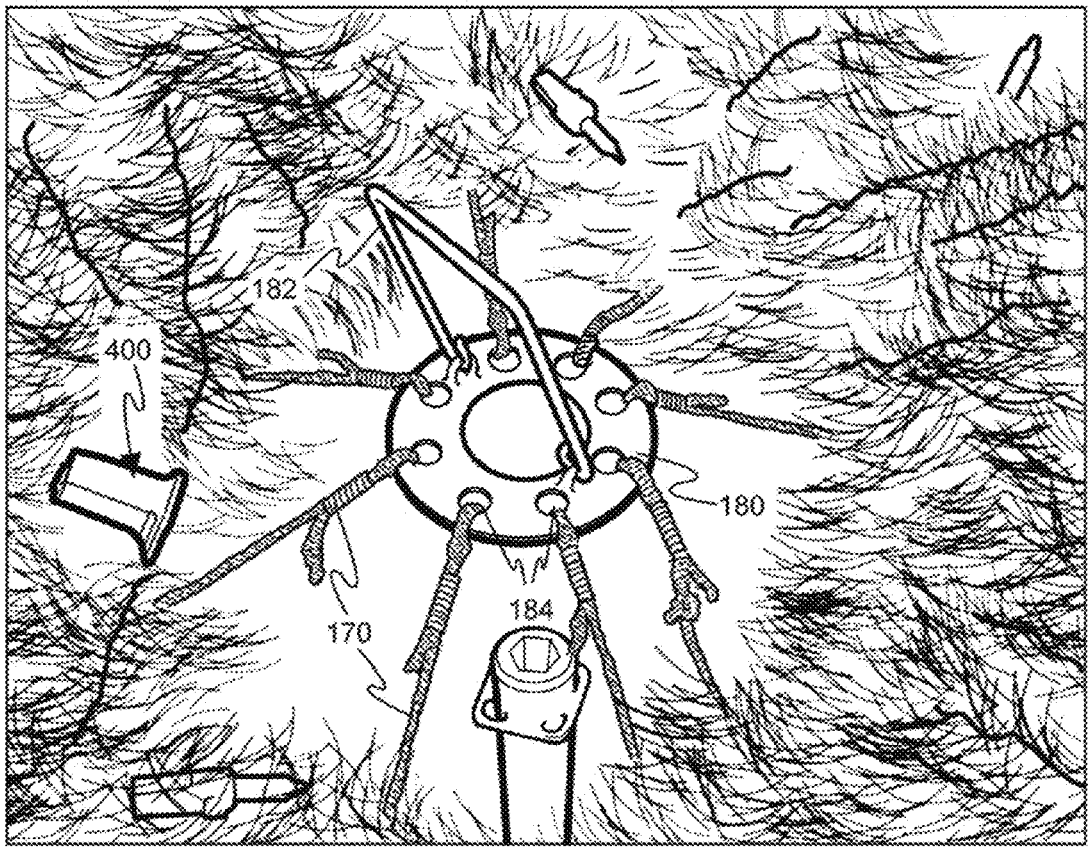
FIG. 6B is a close-up, side, perspective view of a top portion of the first tree assembly pulled up and over the top of the trunk, in accordance with an exemplary embodiment of the present invention.
Figure 7:
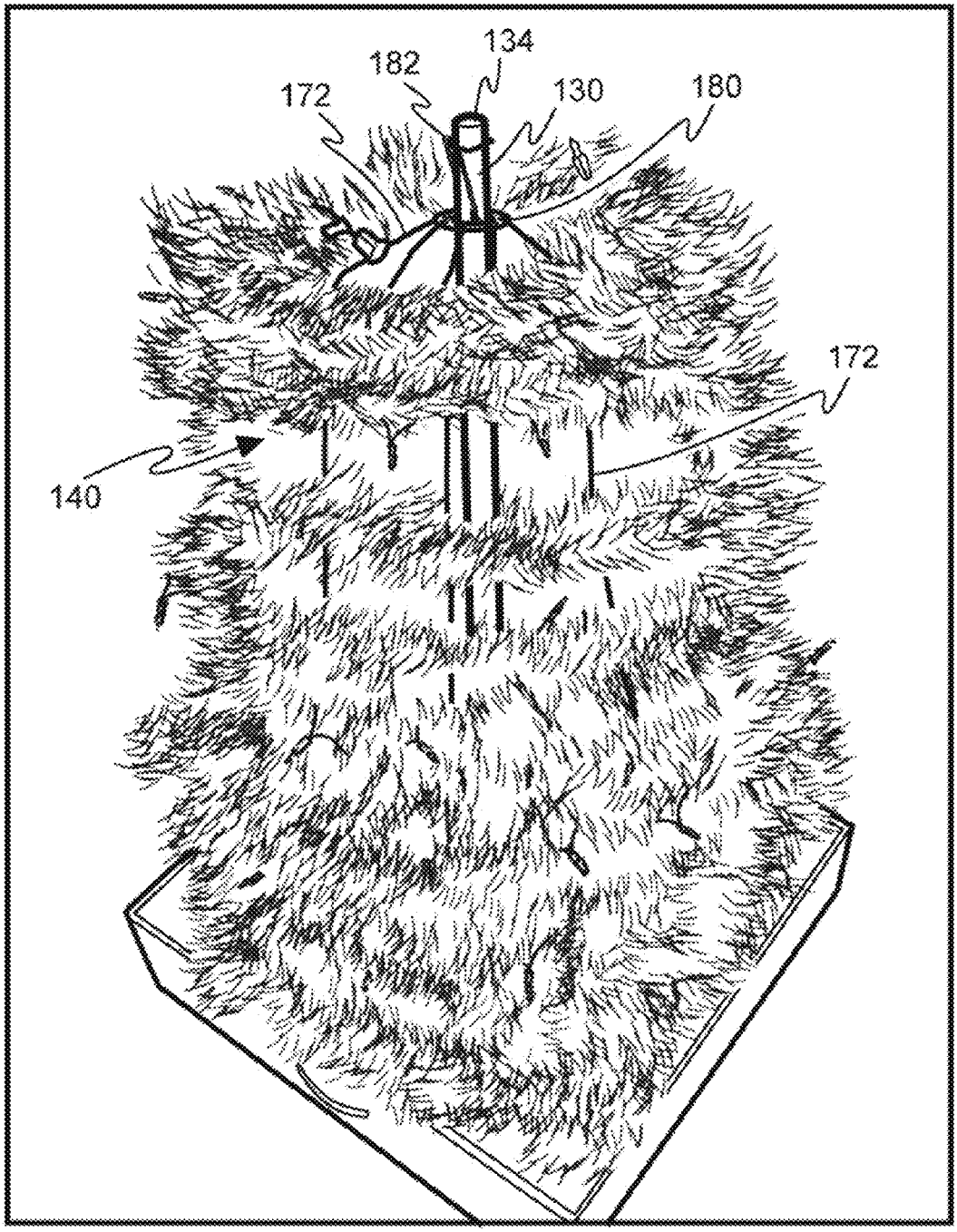
FIG. 7 is a side, perspective view of a first tree assembly fully assembled, in accordance with an exemplary embodiment of the present invention.

As illustrated in FIGS. 3-7, and probably best shown in FIGS. 3 and 7, the first tree assembly 140 is the mechanism that is both collapsible and expandable. In other words, the first tree assembly 140 can be collapsible for storage and can expandable for operation and use. The first tree assembly 140 can collapse/extend both in/outwardly (along the length of its branches) as well as both up/downwardly (along the length of its trunk).

In an exemplary embodiment, the first tree assembly 140 can comprise the entirety of the artificial tree. In another embodiment, the first tree assembly 140 can comprise a bottom portion of the artificial tree 50. In yet another embodiment, the first tree assembly 140 could be a top portion of the tree 50, while still incorporating the collapsible characteristics.

As shown in FIG. 11, the first tree assembly 140 comprises a plurality of frame assemblies 141, each of which comprising a collar 142, a plurality of outwardly extending support braces 143, a perimeter 145, and a plurality of branch assemblies 144. As illustrated in FIG. 11, the perimeter of the frame assembly 141 can be substantially circular in shape.

Figure 12:
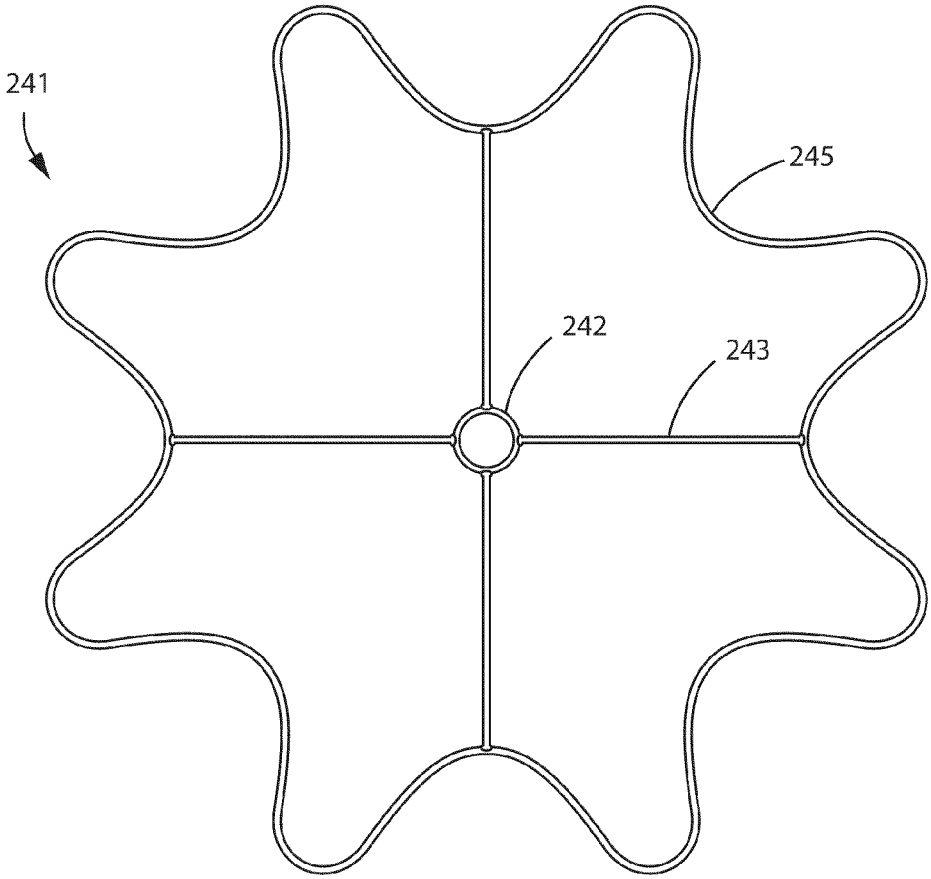
FIG. 12 is a top view of a frame assembly, in accordance with an exemplary embodiment of the present invention.

The frame assembly can have a number of different shapes. For example and not limitation, as illustrated in FIG. 12, the frame assembly 241 can also include a collar 242, a plurality of support braces 243, and a perimeter 245. The shape of the perimeter 245 of the frame assembly 241 of FIG. 12 is different from the perimeter 145 of the frame assembly 141 of FIG. 11. The perimeter 245 of the frame assembly 241 of FIG. 12 can include a plurality of waves. For example and not limitation, and as illustrated in FIG. 12, the perimeter 245 can include at least eight waves that weave away and towards the center collar 242. By shaping the perimeter 245 in this manner, the branches that are ultimately carried by the perimeter 245 can provide a varied, variegated, and tree-like shape.

Figure 13:
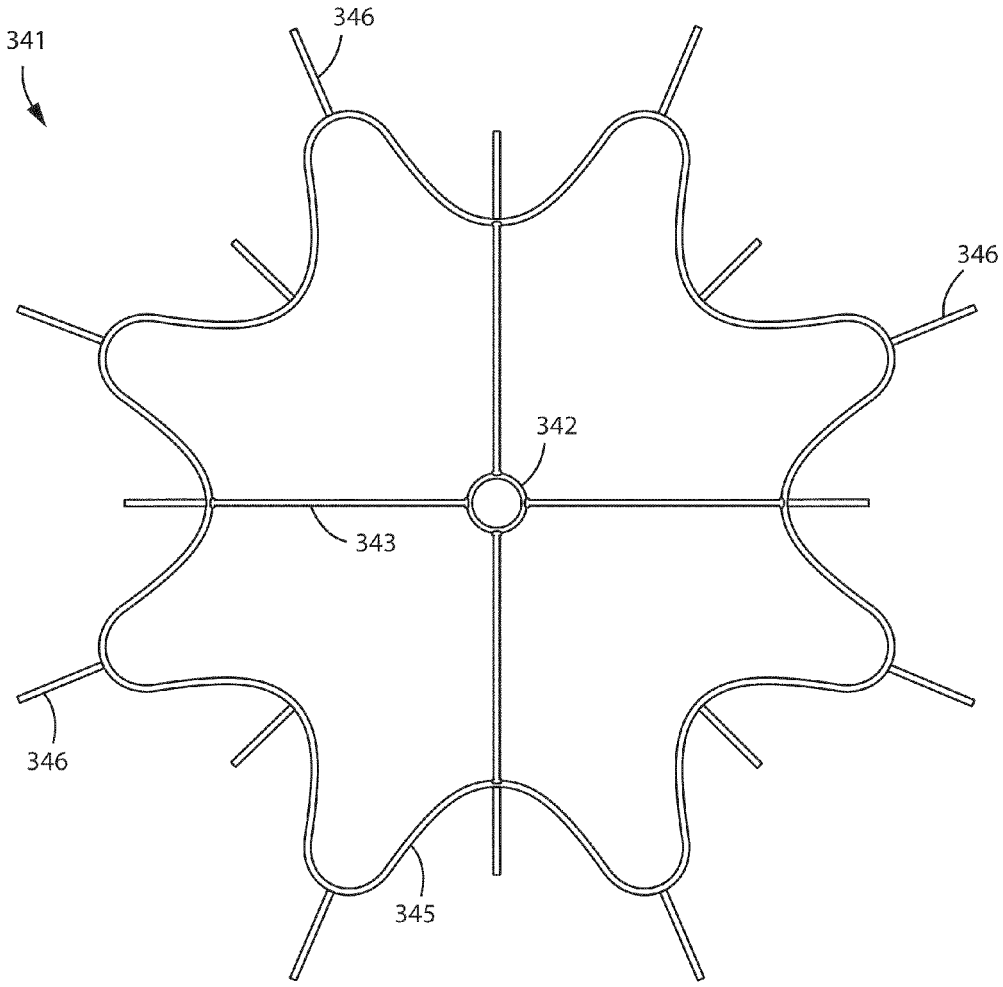
FIG. 13 is a top view of another frame assembly, in accordance with an exemplary embodiment of the present invention.

Similarly, as illustrated in FIG. 13, a frame assembly 341 includes a collar 342, a plurality of support braces 343, a perimeter 345, and a plurality of protruding members 346. The plurality of protruding members 346 can be incorporated in the frame assembly 141 (e.g., circular shaped) and/or the frame assembly 241 (e.g., wave or star shaped). The plurality of protruding members 346 can extend outwardly from the perimeter 345; in some embodiments they may extend in outwardly normal their perimeter. In some embodiments, the plurality of protruding members 346 can be welded to the perimeter 345. The protruding members 346 are adapted to support one or more artificial tree branches.

In order to expand the tree 50 from a collapsed state, a trunk 130 is first assembled into the pull up tree system 100.

The trunk 130 is of rigid construction and includes a first end 132 a second end 134. The first end 132 is in communication with the base 122 of the base system 120. For example, the trunk 130 can be positioned substantially vertical by being coupled to the base 122. More specifically, a first end 132 of the trunk 130 can be insertable into and cooperatively received by a cavity 126 of the base 122. The trunk 130 has an elongated shape and can be a single pipe or, alternatively, a plurality of interconnecting pipes, of circular cylindrical configuration. The trunk 130 can be positioned in the approximate vertical orientation when inflated with a medium, such as being a blow-up type of trunk.

Figure 14:
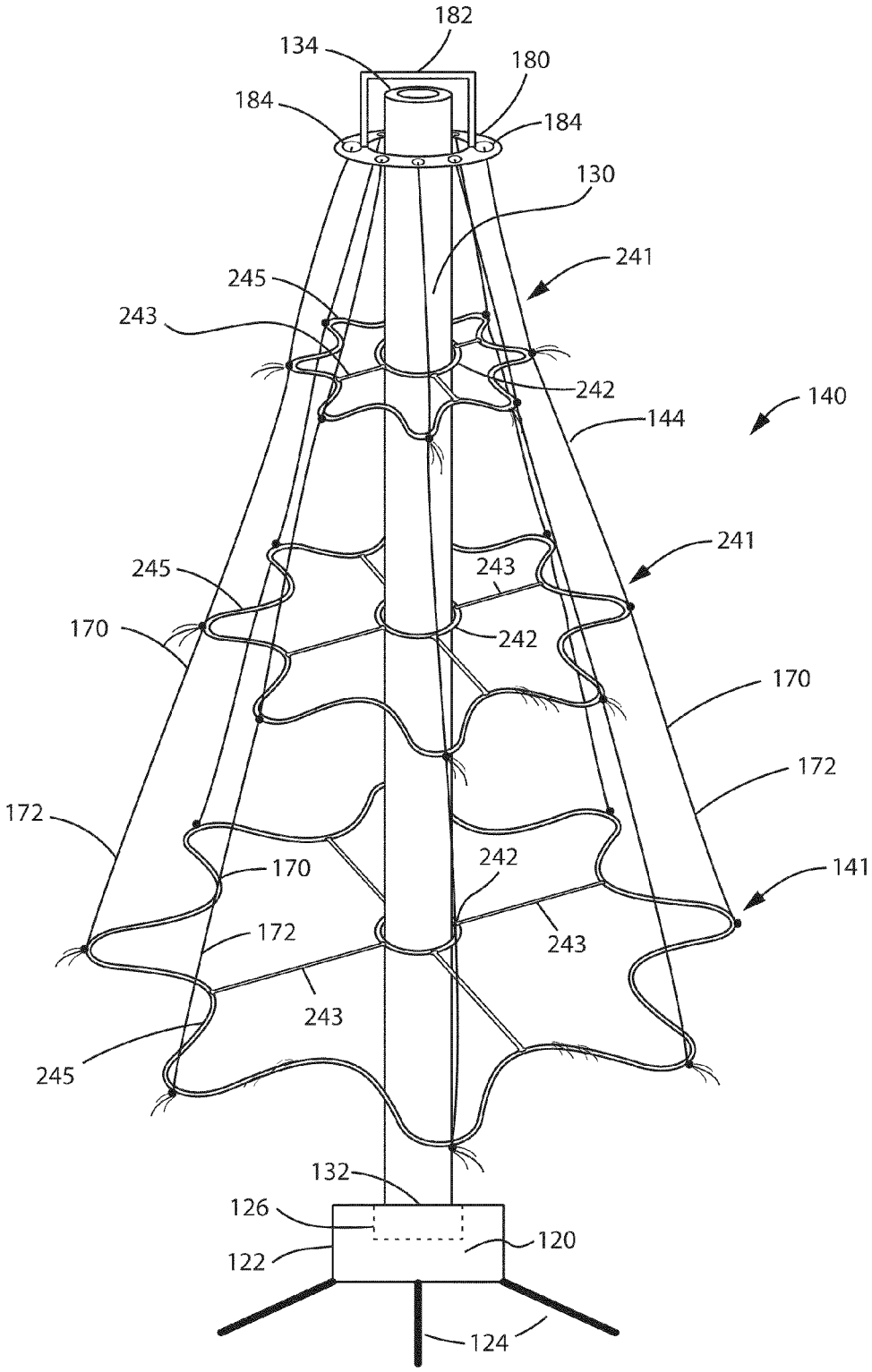
FIG. 14 is a side, perspective view of the top portion, the connection assembly, and the plurality of frame assemblies of FIG. 12, in accordance with an exemplary embodiment of the present invention.
Figure 15:
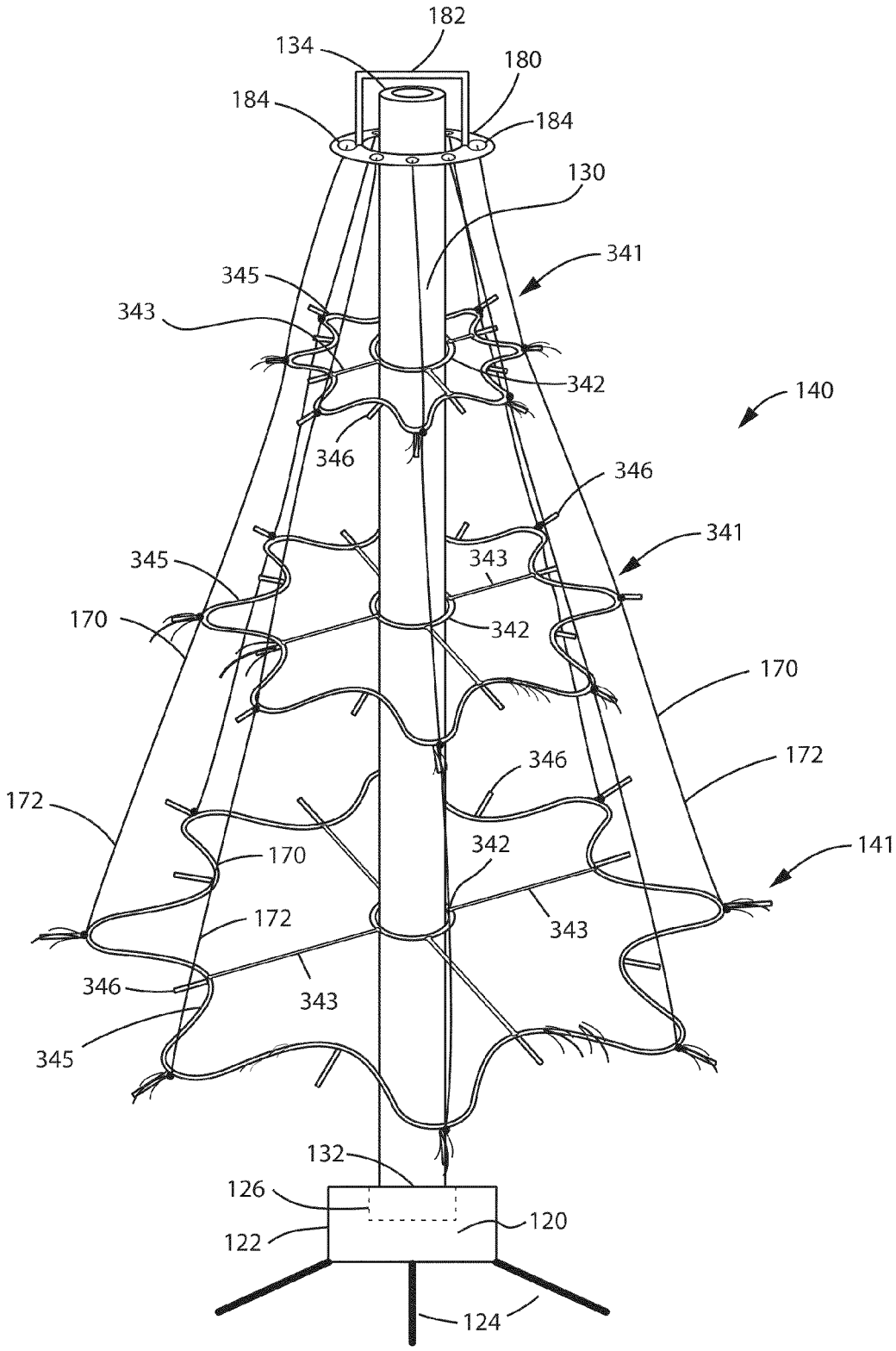
FIG. 15 is a side, perspective view of the top portion, the connection assembly, and the plurality of frame assemblies of FIG. 13, in accordance with an exemplary embodiment of the present invention.

As depicted in FIGS. 11 and 14-15, the plurality of frame assemblies 141/241/341 can be positioned about the trunk 130. For instance, each collar 142/242/342 of the plurality of frame assemblies 141/241/341 can initially encircle the trunk 130. In an exemplary embodiment, when the trunk 130 is in communication with the base 122, the first tree assembly 140 can begin in a collapsed state and hence the trunk 130 extends upwardly from the base 122. Each collar 142/242/342 of the plurality of frame assemblies 141 surrounds the trunk 130, which as a result, the collar 142/242/342 is slidably disposed upon the trunk 130.

Extending from each collar 142/242/342 of the plurality of frame assemblies 141 are a plurality of outwardly extending support braces 143/243/343. For each frame assembly 141/241/341, each of the outwardly extending support braces 143/243/343 extends from the collar 142/242/342 to the perimeter 145/245/345. As mentioned, the perimeter 145/245/345 can hold a plurality of branch assemblies 144, for providing the artificial tree look.

Depending on the desired shape of the artificial tree, the size and shape of each of the plurality of frame assemblies 141/241/341 can vary. In an exemplary embodiment, diameter of the frame assemblies 141/241/341 can increase going from the top to the bottom; as a result, the look of the artificial tree 50 when in its operable state presents a triangle shape with the point at the top (i.e., a right side up tree). In an alternative embodiment, the diameter of the frame assemblies 141/241/341 can decrease going from top to bottom; as a result, the look of the artificial tree when in its operable state presents a triangle show with the point at the bottom (i.e., an upside down tree). Also, the shape of the perimeter 145/245/345 can vary, as generally illustrated in FIGS. 11-13.

Still referring to FIGS. 11 and 14-15, the connection assembly 170 of the first tree assembly 140 extends from a top portion 180 of the first tree assembly 140 and connects each of the frame assemblies 141. The connection assembly 170 can be flexible, and in an exemplary embodiment includes a plurality of strings 172 coupled near a first end to the top portion 180, e.g., wrapped within an aperture 184 of the top portion 180, and is connected along its length to each perimeter 145/245/345 of the plurality of frame assemblies 141/241/341 and ultimately terminates near the perimeter 145/245/345 of the lowest frame assembly.

Figure 16:
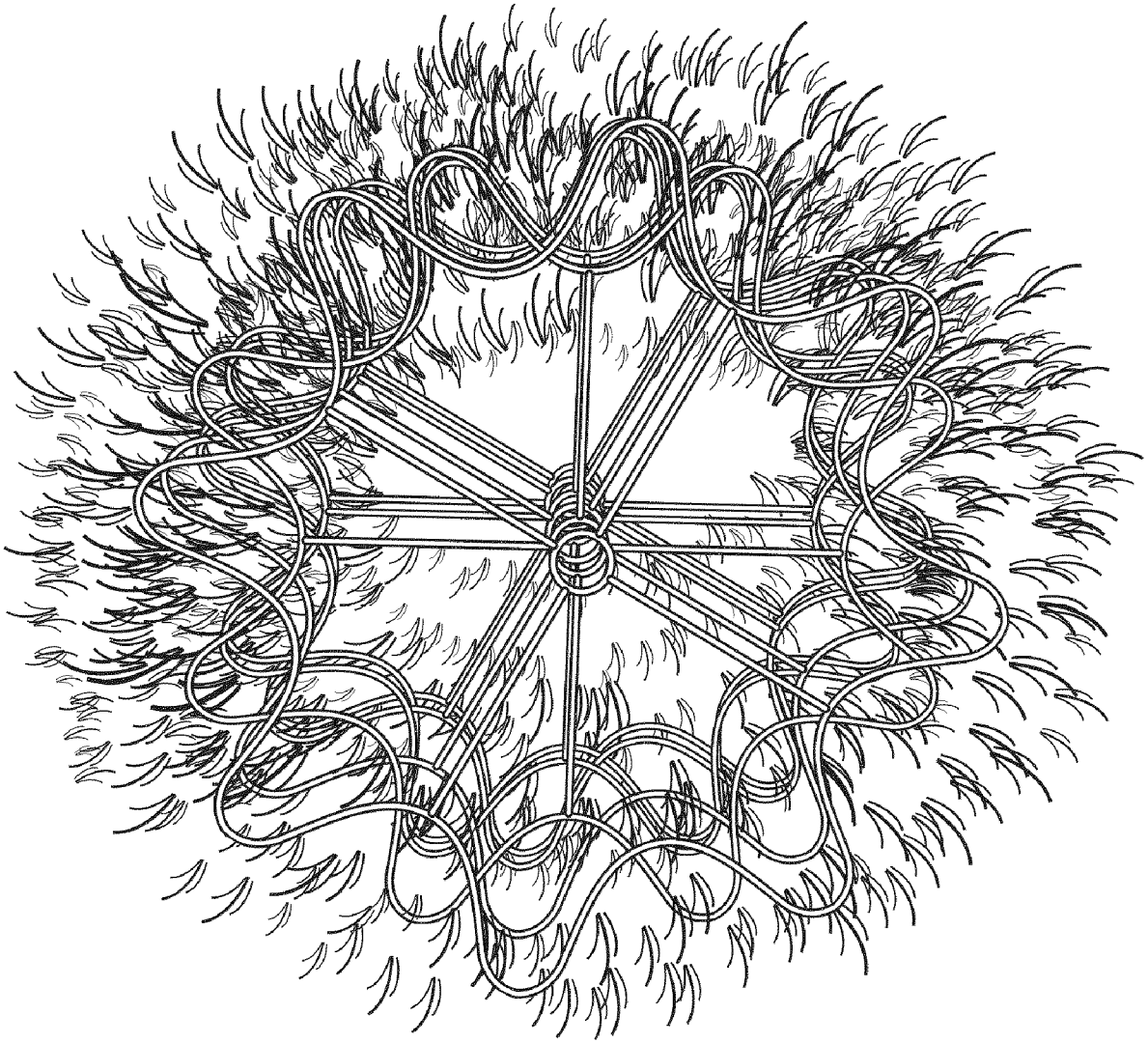
FIG. 16 is a side, perspective view of a plurality of frame assemblies in an aligned orientation, in accordance with an exemplary embodiment of the present invention.
Figure 17:
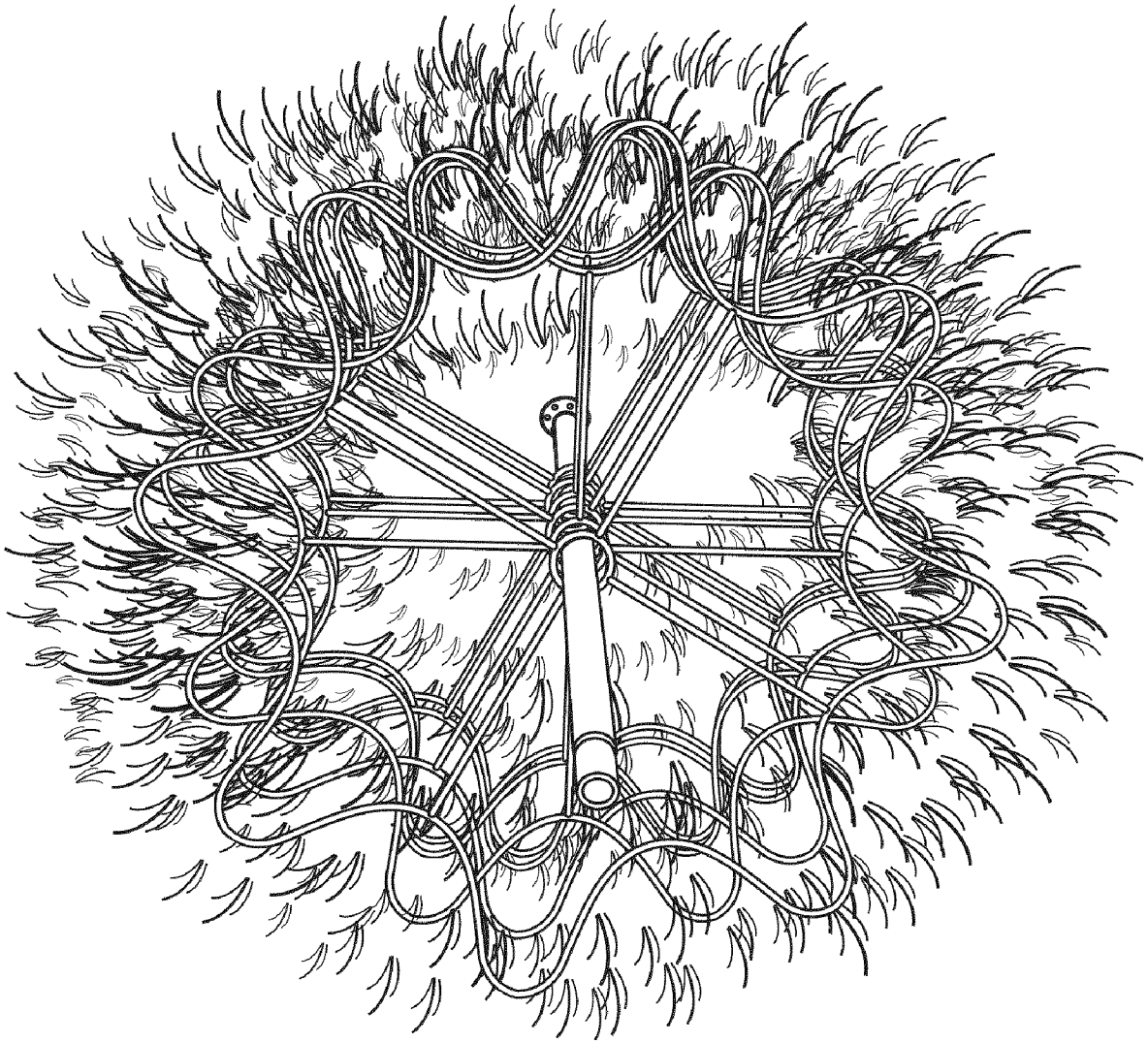
FIG. 17 is a side, perspective view of a plurality of frame assemblies in an aligned orientation and encircling the trunk, in accordance with an exemplary embodiment of the present invention.

When the first tree assembly 140 is in the collapsed state and the trunk 130 is coupled to the base 122, and hence the trunk 130 extends upwardly therefrom, a handle 182 in communication with the top portion 180 of the first tree assembly 140 can be pulled upwardly, such that each collar 142/242/342 of the plurality of frame assemblies 141/241/341 can slide along the length of the trunk 130. For example, FIGS. 16-17 illustrate a plurality of frame assemblies aligned and configured to enable their collars to slide along the length of the trunk. When the top portion 180, e.g., the handle 182 reaches the second end 134, or the top, of the trunk 130, the first tree assembly 140 is assembled. Also, when the handle 182 is pulled upwardly the connection assembly 170 pulls all the plurality of frame assemblies 141/241/341 upwardly. As a result, each of the branch assemblies 144 is separated from one another and thus collectively provides the illusion of a partially/fully assembled tree. FIG. 7 illustrates the first tree assembly 140 locked in this expanded state. In some embodiments, as illustrated in FIG. 6B the handle 182 can be covered with a cushion device 183, which can ease the task of pulling the tree upwardly. For example, the cushion device 183 can encircle or placed around the perimeter of the handle for such support.

In an exemplary embodiment, the tree assembly 140 can include one or more of the various frame assemblies 141, 241, and/or 341. For example, in some embodiments the tree assembly 140 can include only one type of frame assembly of the same shape, for example and not limitation all the frame assembly 141, which may be of various diameters/sizes. In some embodiments, however, the tree assembly 140 can include different frame assemblies 141, 241, 341, which may be of the same or varying diameters.

As shown in FIGS. 16-17, the perimeter of each frame assembly can have a wave shape. As the waves stack up on the trunk of the tree, they can alternate orientations. For example, frame assembly layers 1, 3, 5, and 7 have a first position about the axis of the trunk and frame assembly layers 2, 4, and 6 have a second position about the axis of the trunk. The degree to which one of the frame assembly layers is offset from another can be such that the peak of a wave of a first layers is above the nadir of the trough of the layers directly above and below same.

In an exemplary embodiment, the branch assemblies 144 include a plurality of branches, each comprising a plurality of tips. The branch assemblies 144 can be made of polyethylene (PE) and/or polyvinyl chloride (PVC). PE and PVC branch assemblies are both made of plastic, but PE trees are made of molded plastic, based on branches from a real tree. In various embodiments, the branches can comprise PE alone, PE and PVC, PVC alone, PE with another artificially-made branch, and/or PVC with another artificially-made branch.

Further, as shown in FIGS. 6A-6B, with a locking mechanism 150 of the top portion 180, the first tree assembly 140 can be secured in the operable, or assembled, orientation. In an exemplary embodiment, the locking mechanism 150 can incorporate the handle 182, which can be positioned atop and coupled to the top portion 180. In another exemplary embodiment, the handle 182 can be secured or locked in communication with a portion of the trunk 130. Exemplarily, the locking mechanism 150 secures a portion of the top portion 180 relative to the second end 134 of the trunk 130.

In some embodiments, the top portion 180 of the first tree assembly can rest on a square peg 187 in proximity to the top of the trunk 130, which can effectively lock the pull up tree assembly in the erect state. In some embodiments, the locking mechanism can further be provided to further lock the erect state.

To assemble, or erect the pull up tree system, the top portion of the first tree assembly can be pulled upwardly. For example, in one embodiment, the top portion of the first tree assembly can be lifted up an over the top of the trunk (see FIG. 6B) to be locked thereto. In another embodiment, the top portion of the first tree assembly can be lifted upwardly, to slide along the trunk (FIG. 6A). In either situation, the collars can slide along the trunk; for example, by lifting the top portion upwardly the connection assembly can pull the collars upwardly.

To disassemble, or knock down the pull up tree system from an operable, erect state, the top portion can be lifted over the top of the trunk and then lowered. Then, the trunk can be removed from the collars and the artificial tree can be slid into the container. In an exemplary embodiment, the locking mechanism can be unlocked and the top portion can be slid downwardly along the trunk. Then, the trunk can be removed from the collars and the artificial tree can be slid into the container.

If the first tree assembly 140 does not incorporate the entire artificial tree look, e.g., a top end is needed; consequently, a second tree assembly 160 can be coupled to the top of the first tree assembly 140.

Figure 8:
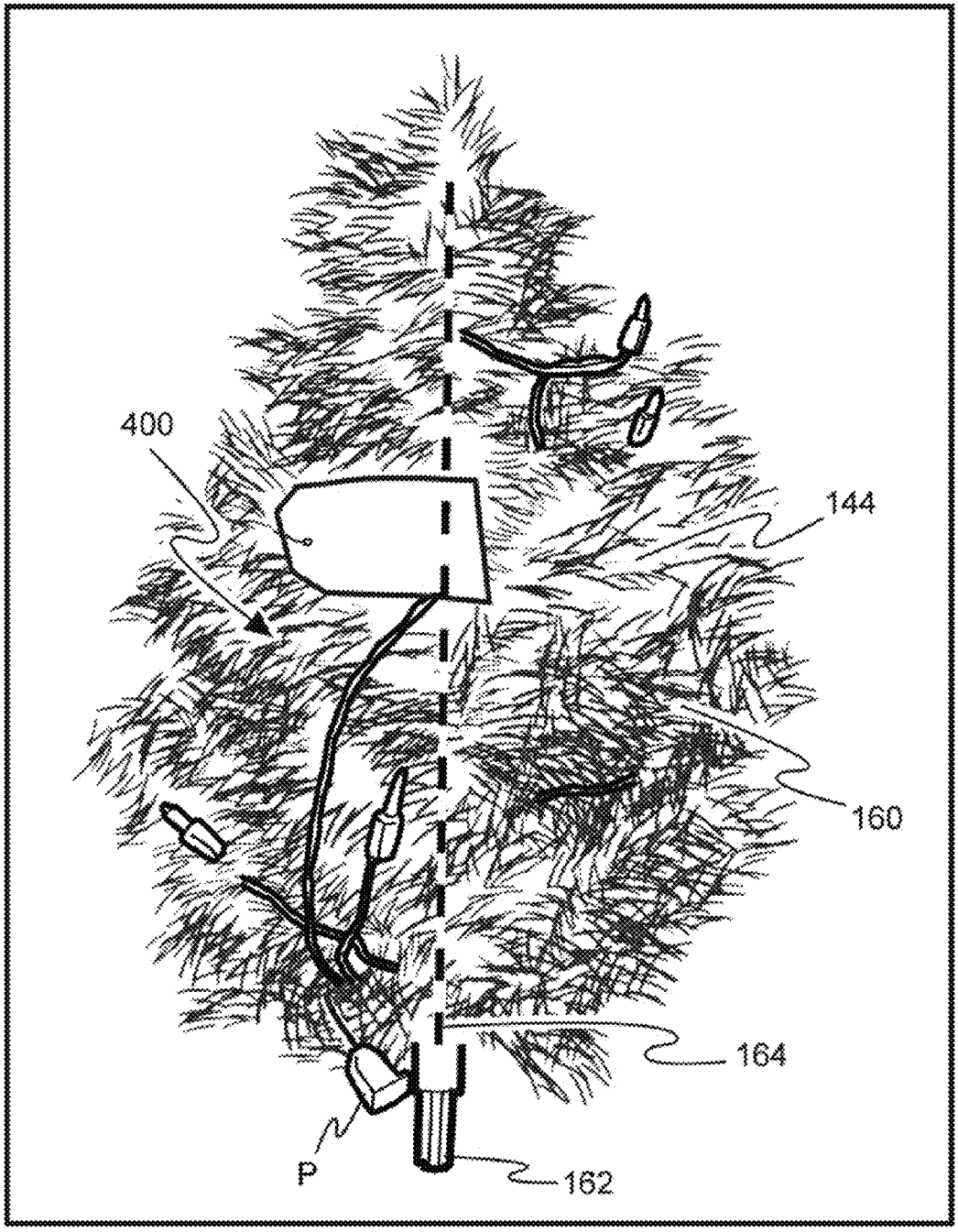
FIG. 8 is a side view of a second frame assembly providing a top of the pull up tree system, in accordance with an exemplary embodiment of the present invention.
Figure 9:
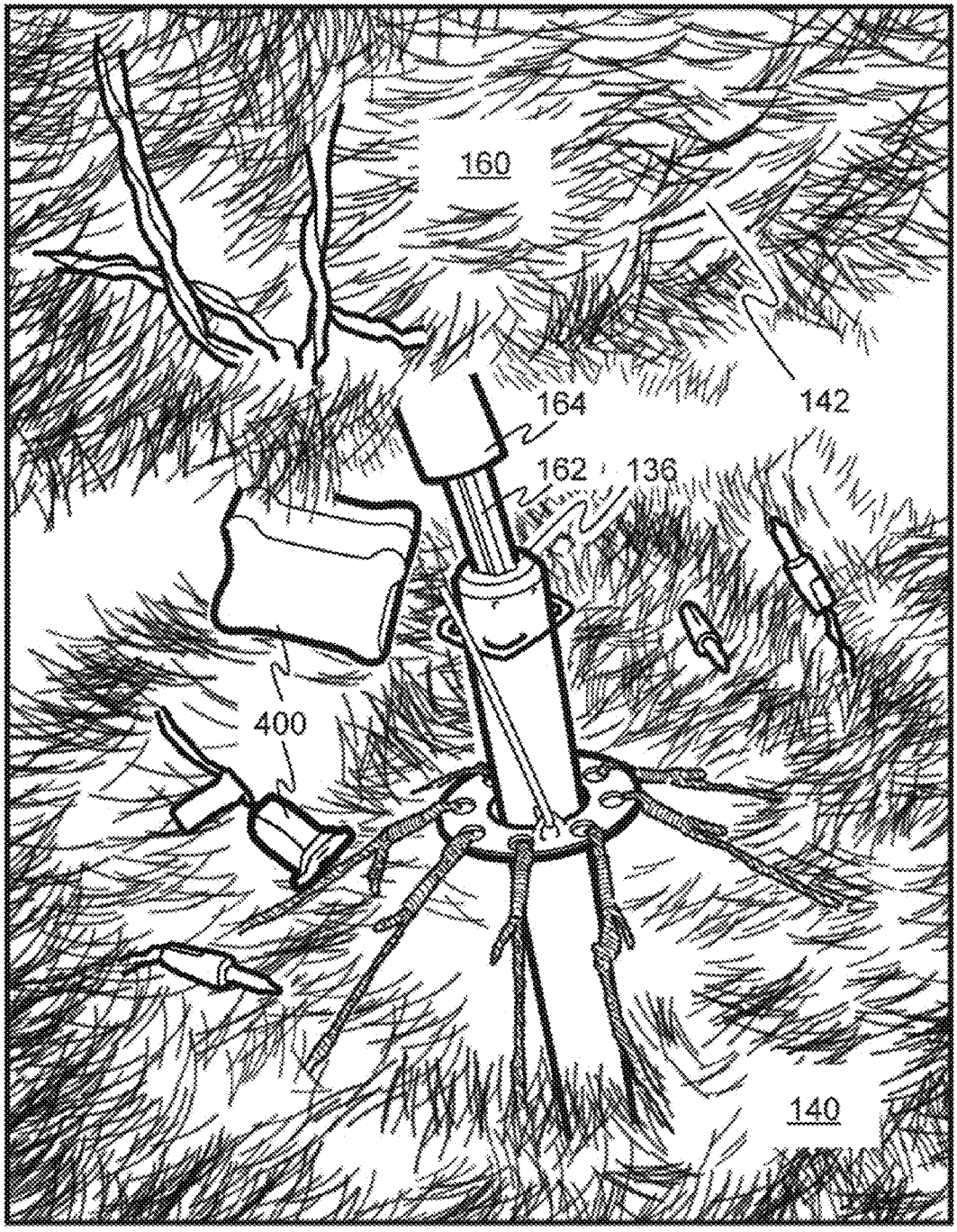
FIG. 9 is a side view of the second frame assembly being connected to the trunk of the first tree assembly, in accordance with an exemplary embodiment of the present invention.
Figure 10:
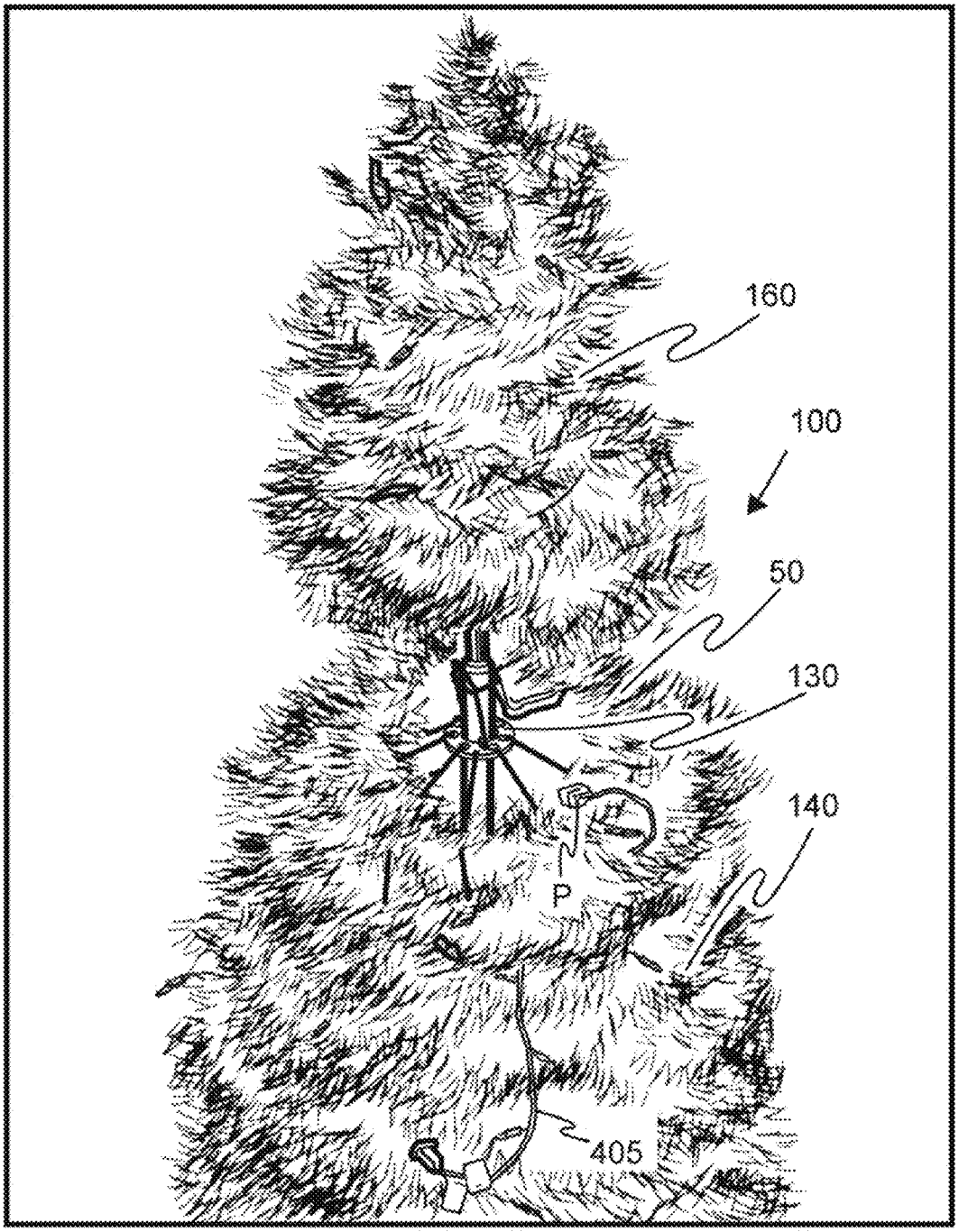
FIG. 10 is a side, perspective view of the fully assembled pull up tree system in an operable state, in accordance with an exemplary embodiment of the present invention.

As illustrated in FIGS. 8-10, the second tree assembly 160 can comprise a top portion of the artificial tree 50. In an exemplary embodiment, the second tree assembly 160 is couplable to the second end 134, e.g., the top, of the trunk 130. For example, an end 162 of the second tree assembly 160 is insertable and can be received by an aperture 136 of the second end 134 of the trunk 130 or vice versa. In an exemplary embodiment, the second tree assembly 160 can be static, that is, it is not collapsible.

The second tree assembly 160 includes a plurality of outwardly extending branch assemblies 144. The second tree assembly 160 includes a member 164 from which the branch assembles 144 extend outwardly therefrom. In an exemplary embodiment, the branch assemblies 144 are pivotable about the member 164. In other words, these branch assemblies 144 for the second tree assembly 160 are flexible, such that they can be repositioned relative to both one another and the member 164. In an exemplary embodiment, the second tree assembly 160 can be collapsible, like the first tree assembly 140.

The pull up tree system 100 can support and incorporate a regularly arranged artificial tree and/or an inverted arranged artificial tree.

In various aspects of the artificial tree 50, it can be decorated, such that ornaments, light string system(s), and the like hang therefrom. In addition, the light string systems 400 can be integral with the plurality of the branch assemblies, such that the artificial tree comes with a light string system weaved therethrough.

The pull up tree system 100 can further include the light string system 400. The light string system 400 includes a bulb, a socket, and associated wiring. It can include wiring 405 in communication with a plug P. The light string system 400 is preferably electrically series-connected, though it can be electrically parallel-connected. Light string system 400 can be in communication with the first tree assembly 140. That is, the light string system 400 can be carried by the first tree assembly 140.

Figure 18A:
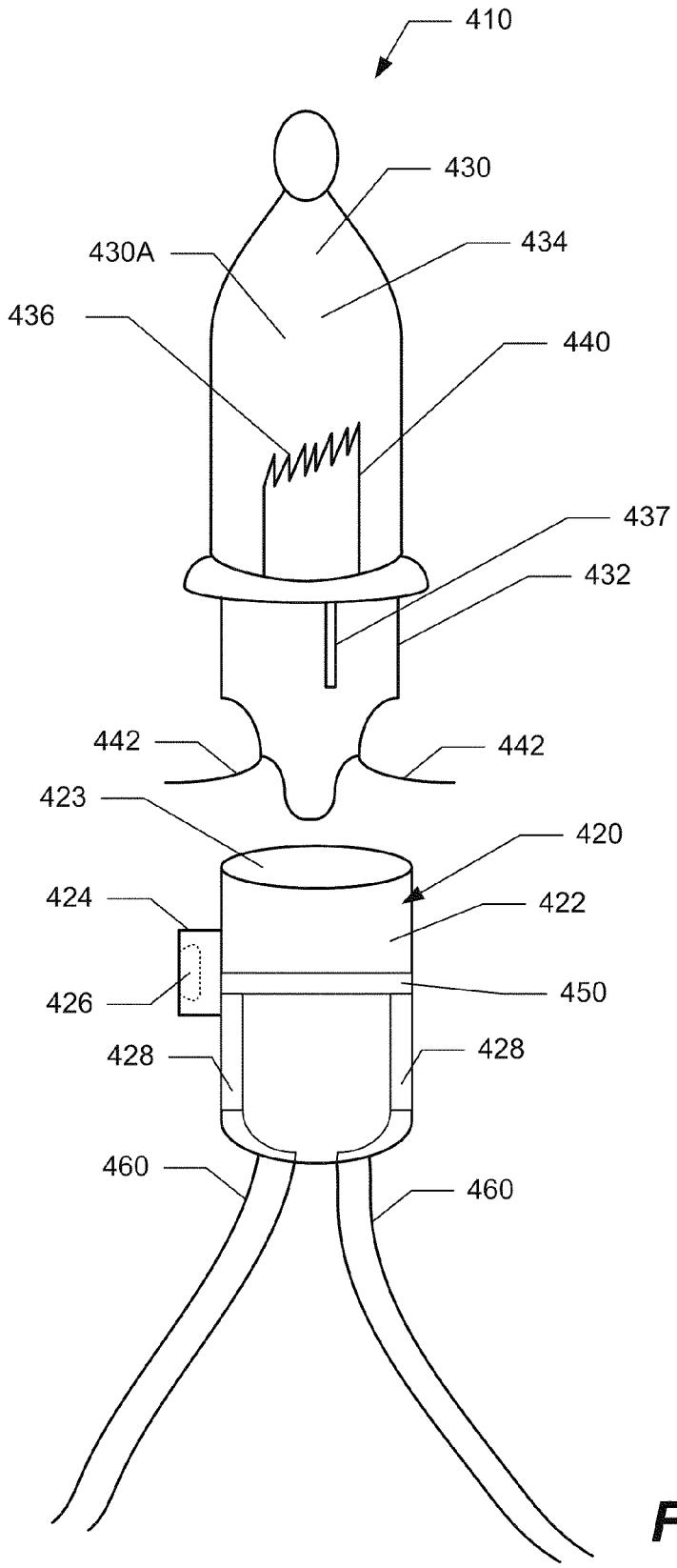
FIG. 18A is a side, partial cross-sectional view of a bulb assembly of the light string system, in accordance with an exemplary embodiment of the present invention.
Figure 18B:
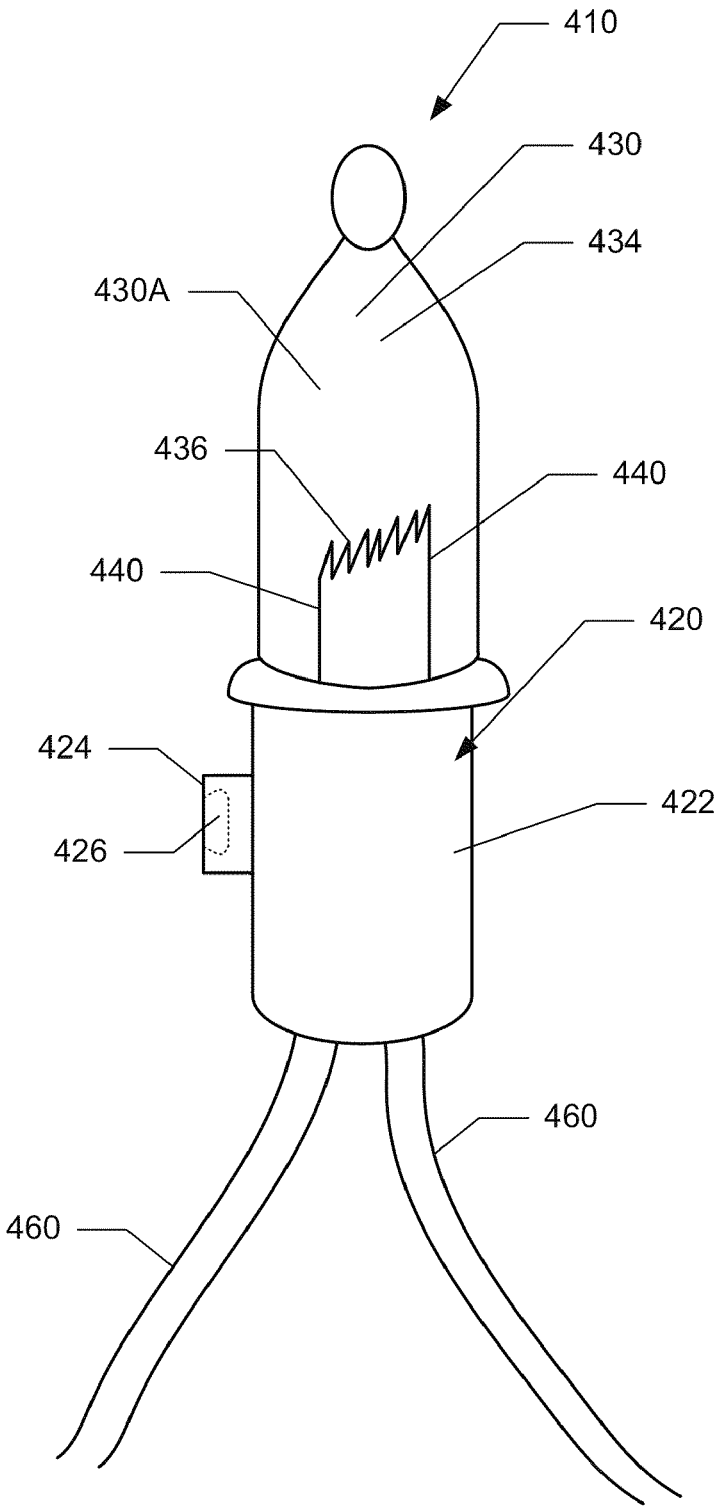
FIG. 18B is a side, partial perspective view of the bulb assembly of the light string system of FIG. 18A, wherein the light bulb is seated in the socket assembly, in accordance with an exemplary embodiment of the present invention.

Referring now to FIGS. 18A-18B, the light string system 400 comprises a plurality of bulb assemblies 410, each bulb assembly 410 including a light source 430, a base 432, and a socket assembly 420.

The light source 430 provides light when energized. The light source 430 can be many types of light sources, including a light bulb, light emitting diode (LED), incandescent lamp, halogen lamp, fluorescent lamp, and the like. In an exemplary embodiment, the light source 430 is a light bulb 430A. The bulb assembly 410 can include a shunting mechanism to keep a light string system 400 illuminated, even if one of its light bulbs 430A burns out.

The light bulb 430A can include a globe 434 and a filament 436. The globe 434 is in communication with, and terminates at, the base 432. The globe 434 can be made of conventional translucent or transparent material such as plastic, glass, and the like. Typically, the globe 434 defines a hollow interior enabling protection of the filament 436.

The filament 436, when charged with energy, can illuminate the light bulb 430A. Conductors 440 can be in electrical communication with the filament 436. The conductors 440 enable energy into the light bulb 430A to illuminate the filament 436, and thus the light bulb 430A. The conductors 440 extend down through the base 432, wherein the conductors 440 can be in communication with a pair of lead wires 442 external the base 432. The lead wires 442 extend through a bottom of the base 432, and can be wrapped around the base 432 extending upwardly in the direction of globe 434, adjacent the base 432.

The bulb assembly 410 further includes the base 432. The base 432 can be integrally formed with the light source 430. The base 432 can be a unitary element of the light bulb 430A, or a separate element. The base 432 communicates between the light bulb 430A and an associated socket 422 of the socket assembly 420, complimenting and facilitating the seating of the light bulb 430A to the socket 422. The base 432 can incorporate at least one ridge 437 to ensure a snug fit with the socket 422, preventing the accidental disengagement of the light bulb 430A from the socket assembly 420. Other mechanical means can be used with the base 432 and the socket assembly 420 to ensure a tight fit.

The socket assembly 420 comprises the socket 422 adapted to receive the light bulb 430A/base 432. The socket 422 defines a cooperatively-shaped aperture 423 to receive the base 432 of the bulb assembly 410. The socket 422 can be arranged in many shapes and sizes, but as one skilled in the art will recognize, the socket 422 should be of a shape to conveniently receive the light bulb 430A/base 432.

The socket 422 includes a pair of socket terminals 428. The socket terminals 428 are located on opposing inner sides of the socket 422. The socket 422 further includes a pair of terminal wires 460 extending to the exterior to allow energy to enter (and exit) the socket 422. Each socket terminal is, essentially, an extension of each respective terminal wire 460. The terminal wire 460 extends through the bottom of the socket 422 and is ultimately connected to an electrical source.

Light strings systems 400 are typically arranged with bulb assemblies 410 on the strings being electrically connected in series, rather than in a parallel arrangement. Unfortunately, there are disadvantages to designing a light string in series. When even a single light bulb is removed from a socket, the entire series of lights is rendered inoperable. Because each light bulb within its respective socket completes the electrical circuit, when a light bulb is removed or the filament of the bulb burns out, a gap is created in the circuit; that is, an open circuit is formed. Thus, electricity is unable to continue to flow through the circuit.

To overcome this dilemma, the socket assembly 420 can include a shunting device 450 to enable the energy flowing through the light string system 400 to continue to flow even when a light source 430 is absent from the socket 422. For instance, the light bulbs 430A in the light string system 400 will remain illuminated even though there may exist: an open filament 436, for example, a dead light bulb 430A, faulty or damaged light bulb 430A, faulty socket 422, or simply because the light bulb 430A is not properly mounted in its respective socket 422, or is entirely removed or falls out of its respective socket 422. For instance, the bypass activating system described in U.S. Ser. No. 11/473,504, filed Jun. 23, 2006, the entire disclosure of which is incorporated herein by reference, can be used as the shunting device 450.

In an exemplary embodiment, the bulb assemblies 410 of the light string system 400 can comprise an outwardly extending member 424 for securing to a branch assembly 144 of the first tree assembly 140. The extending member 424 can be locked to a portion of the branch assembly 144, such that the bulb assemblies 410 do not hang at undesired angles or do not move when a pet or person brushes or accidentally shakes the tree 50. For example, the extending member 424 includes an extending member aperture 426 that is clippable to one branch assembly 144.

In an aspect of the present invention, a method of assembling an artificial tree comprises sliding a device carrying the artificial tree from a storage container; positioning a trunk in an approximate vertical orientation within an approximate center of the artificial tree; and pulling upwardly on the artificial tree. The method can further comprise locking a top portion of the artificial tree in proximity to a top end of the trunk. Moreover, the method can comprise coupling a bottom end of the trunk to a base system. In addition, pulling upwardly on the artificial tree can cause elements of the artificial tree slide along the trunk from a storage state to an operable state. Further, pulling upwardly on the artificial tree includes pulling upwardly and over a top end of the trunk. The device carrying the artificial tree can include a tray or a shell.

In another aspect, a pull up tree system comprises a storage container and an artificial tree. The storage container defines a cavity, which is sufficiently large enough to receive a removable shell. The artificial tree has first and second states, and comprises a base system, a trunk, a first tree assembly, and a connection assembly. The trunk includes a first end and a second end, such that the first end in communication with the base system. The first tree assembly includes a top portion, a plurality of frame assemblies, and a connection assembly. Each of the plurality of frame assemblies comprises a collar slidably disposed about the trunk, a perimeter carrying a plurality of branch assemblies; and a plurality of support braces extending from the collar to the perimeter. The connection assembly of the artificial tree extends from the top portion of the first tree assembly to the bottom most frame assembly, and has a flexible, elongated body. As a result, when the top portion of the first tree assembly is pulled upwardly the artificial tree converts from the first state to the second state.

In addition, the first end of the trunk is insertable into an aperture of the base system. The pull up tree system can further comprise a second tree assembly that is couplable to the second end of the trunk. In addition, the pull up tree system can include a light string system carried by the plurality of branch assemblies. In addition, a locking mechanism can be included for locking the artificial tree in the operable state. The top portion of the first frame assembly can include the locking mechanism for locking the artificial tree in the second state, wherein the locking mechanism is lockable to a location in proximity of the top end of the trunk. Moreover, the connection assembly can include a plurality of strings extending from the top portion to the lowest frame assembly and is coupled to each perimeter of each of the plurality of frame assemblies, such that when the top portion of the first tree assembly is pulled upwardly the connection assembly pulls up the plurality of frame assemblies into the second, operable state.

In yet another aspect, a pull up tree system comprises an artificial tree that may be collapsed into a storage state and erected into an operable state. The pull up tree system includes a base system providing structural integrity for the artificial tree and comprising a base having a plurality of outwardly extending feet; a trunk of rigid construction comprising a first end and a second end, the first end in communication with the base system; and a first tree assembly comprising a top portion, a plurality of frame assemblies, and a connection assembly. Each of the plurality of frame assemblies includes a collar slidably disposed about the trunk, a perimeter carrying a plurality of branch assemblies; and a plurality of outwardly extending support braces extending from the collar to the perimeter. The connection assembly of the first tree assembly extends from the top portion of the first tree assembly to the bottom most frame assembly, and has a flexible, elongated body. When the top portion of the first tree assembly is pulled upwardly the artificial tree converts from the storage state to the operable state.

In another aspect, a pull up tree system may be collapsed into a storage state and erected into an operable state. The pull up tree system comprises a top portion; a plurality of frame assemblies for providing the frame, wherein each frame assembly comprises: a collar slidably disposed about a upwardly extending member; a perimeter providing the shape of the frame; and plurality of support braces extending from the collar to the perimeter for supporting the perimeter; and a connection assembly extending from the top portion to the bottom most frame assembly and coupled to each of the perimeters of each of the frame assemblies, wherein when the top portion of is pulled upwardly the pull up tree system converts from the storage state into the operable state.

The upwardly extending member comprises a trunk, which is coupled to a base system providing structural integrity to the pull up tree system; and the perimeters of each of the plurality of frame assemblies carry a plurality of branch assemblies.

While the invention has been disclosed in exemplary forms, it will be apparent to those skilled in the art that many modifications, additions, and deletions can be made without departing from the spirit and scope of the invention and its equivalents, as set forth in the following claims.

What is claimed is:

1. A pull up tree system comprising:

a storage container defining a cavity, the cavity sufficiently large enough to receive a removable shell;

an artificial tree comprising a first state and a second state, and comprising a base system;

a trunk comprising a first end and a second end, the first end in communication with the base system; and a first tree assembly comprising a top portion, a plurality of frame assemblies, and a connection assembly, each of the plurality of frame assemblies comprising:

a collar slidably disposed about the trunk, a wave-shaped perimeter providing the shape of the frame carrying a plurality of branch assemblies, wherein the perimeter weaves towards and away from the collar;

a plurality of protruding members extending outwardly from the perimeter, each of the plurality of protruding members adapted to carry one or more branch assemblies; and a plurality of support braces extending from the collar to the perimeter, and the connection assembly of the first tree assembly comprising a plurality of strings extending from the top portion to the lowest frame assembly and coupled to each perimeter of each of the plurality of frame assemblies, wherein when the top portion of the first tree assembly is pulled upwardly the connection assembly pulls upwardly the plurality of frame assemblies and the artificial tree converts from the first state to the second state.

2. The system of claim 1, the first end of the trunk insertable into an aperture of the base system.

3. The system of claim 2, further comprising a second tree assembly that is couplable to the second end of the trunk.

4. The system of claim 2, further comprising a light string system carried by the plurality of branch assemblies.

5. The system of claim 2, further comprising a locking mechanism for locking the artificial tree in the second state.

6. The system of claim 2, the top portion of the first frame assembly further comprising a locking mechanism for locking the artificial tree in the second state, the locking mechanism lockable to a location in proximity of the top end of the trunk.

7. The system of claim 1, each of the plurality of frame assemblies further comprising a plurality of protruding members extending outwardly from the wave-shaped perimeter, each of the plurality of protruding members adapted to carry one or more branch assemblies.

8. A pull up tree system comprising an artificial tree that may be collapsed into a storage state and erected into an operable state, the pull up tree system comprising:

a base system providing structural integrity for the artificial tree and comprising a base having a plurality of outwardly extending feet;

a trunk of rigid construction comprising a first end and a second end, the first end in communication with the base system; and a first tree assembly comprising a top portion, a plurality of frame assemblies, and a connection assembly, each of the plurality of frame assemblies comprising:

a collar slidably disposed about the trunk, a perimeter carrying a plurality of branch assemblies, wherein the perimeter weaves towards and away from the collar; and a plurality of outwardly extending support braces extending from the collar to the perimeter, and the connection assembly of the first tree assembly extending from the top portion of the first tree assembly to the bottom most frame assembly, and comprising a flexible, elongated body; and a second tree assembly that is couplable to the second end of the trunk; and wherein when the top portion of the first tree assembly is pulled upwardly the artificial tree converts from the storage state to the operable state.

9. The system of claim 8, the first end of the trunk insertable into an aperture of the base system.

10. The system of claim 8, further comprising a light string system carried by the plurality of branch assemblies.

11. The system of claim 8, the artificial tree housed within a shell that is slidably disposed within a storage container.

12. The system of claim 8, further comprising a locking mechanism for locking the artificial tree in the operable state.

13. The system of claim 8, the top portion of the first frame assembly further comprising a locking mechanism for locking the artificial tree in an operable state, the locking mechanism lockable to a location in proximity of the top end of the trunk.

14. The system of claim 8, the connection assembly comprising a plurality of strings extending from the top portion to the lowest frame assembly and coupled to each perimeter of each of the plurality of frame assemblies, and when the top portion of the first tree assembly is pulled upwardly the connection assembly causes the rise of the plurality of frame assemblies.

15. The system of claim 8, each of the plurality of frame assemblies further comprising a plurality of protruding members extending outwardly from the perimeter, each of the plurality of protruding members adapted to carry one or more branch assemblies.

16. A pull up tree system that may be collapsed into a storage state and erected into an operable state, the pull up tree system comprising:

a top portion;

a plurality of frame assemblies for providing the frame, each frame assembly comprising:

a collar slidably disposed about an upwardly extending member;

a perimeter providing the shape of the frame, wherein the perimeter weaves towards and away from the collar; and a plurality of protruding members extending outwardly from the perimeter, each of the plurality of protruding members adapted to carry one or more branch assemblies; and a plurality of support braces extending from the collar to the perimeter for supporting the perimeter; and a connection assembly extending from the top portion to the bottom most frame assembly and coupled to each of the perimeters of each of the frame assemblies, wherein when the top portion of is pulled upwardly the pull up tree system converts from the storage state into the operable state.

17. The pull up tree system of claim 16, the upwardly extending member comprising a trunk; the trunk coupled to a base system providing structural integrity to the pull up tree system; and the perimeters of each of the plurality of frame assemblies carrying a plurality of branch assemblies.

18. The pull up tree system of claim 16, wherein pulling upwardly on the pull up tree system causes each frame assembly to slide along the upwardly extending member, and wherein the top portion fits over a top end of the upwardly extending member for locking the pull up tree in the operable state.

* * * * *